US011458999B2

(12) United States Patent
Tokumaru

(10) Patent No.: US 11,458,999 B2
(45) Date of Patent: Oct. 4, 2022

(54) ON-BOARD CONTROL APPARATUS AND PLATFORM-DOOR CONTROL SYSTEM

(71) Applicant: Mitsubishi Electric Corporation, Tokyo (JP)

(72) Inventor: Makoto Tokumaru, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 462 days.

(21) Appl. No.: 16/492,735

(22) PCT Filed: Mar. 22, 2017

(86) PCT No.: PCT/JP2017/011400
§ 371 (c)(1),
(2) Date: Sep. 10, 2019

(87) PCT Pub. No.: WO2018/173142
PCT Pub. Date: Sep. 27, 2018

(65) Prior Publication Data

US 2021/0139053 A1 May 13, 2021

(51) Int. Cl.
*B61B 1/02* (2006.01)
*B61L 25/02* (2006.01)
(Continued)

(52) U.S. Cl.
CPC ..... *B61B 1/02* (2013.01); *B61D 19/02* (2013.01); *B61L 25/025* (2013.01);
(Continued)

(58) Field of Classification Search
CPC ..... B61B 1/02; B61D 19/02; B61L 25/025; B61L 27/40; B61L 25/021; B61L 27/04
See application file for complete search history.

(56) References Cited

U.S. PATENT DOCUMENTS 9,487,212 B1 11/2016 Adam et al.
2005/0279891 A1* 12/2005 Ebuchi ..... B61L 25/025 246/122 R
(Continued)

FOREIGN PATENT DOCUMENTS

JP 2002067958 A 3/2002
JP 2002321618 A 11/2002
JP 2016124365 A 7/2016

OTHER PUBLICATIONS

International Search Report (PCT/ISA/210) dated Jun. 20, 2017, by the Japan Patent Office as the International Searching Authority for International Application No. PCT/JP2017/011400.
(Continued)

*Primary Examiner* — Mark T Le
(74) *Attorney, Agent, or Firm* — Buchanan Ingersoll & Rooney PC

(57) ABSTRACT

A platform-door control system includes an on-board control apparatus provided in a train, and a platform-door control apparatus. The on-board control apparatus includes: a ground-coil information storage unit to store information on a ground coil located on a track on which the train runs; a train-position detection unit to detect a position of the train; a train stop-position specification unit to determine a train stop position on the basis of stored information on the ground coil, and train position information detected by the train-position detection unit; a vehicle-door specification unit to determine a vehicle door of the train to be opened/closed, on the basis of the determined train stop position; and a vehicle-door information output unit to output determined vehicle door information of the train. The platform-door control apparatus receives the vehicle door information output from the vehicle-door information output unit, and controls platform doors installed at a station.

14 Claims, 16 Drawing Sheets

(51) Int. Cl.

| | |
|---|---|
| ***B61D 19/02*** | (2006.01) |
| *B61L 27/04* | (2006.01) |
| *B61L 27/40* | (2022.01) |

(52) U.S. Cl.

CPC ..... *B61L 25/021* (2013.01); *B61L 27/04* (2013.01); *B61L 27/40* (2022.01)

(56) References Cited

U.S. PATENT DOCUMENTS

| | | | | |
|---|---|---|---|---|
| 2018/0001917 | A1* | 1/2018 | Kaede | B61L 3/221 |
| 2018/0327005 | A1* | 11/2018 | Yamamoto | B61L 25/025 |
| 2019/0039634 | A1* | 2/2019 | Tokumaru | B61L 25/025 |
| 2019/0315382 | A1* | 10/2019 | Tokumaru | B61L 27/40 |
| 2020/0013286 | A1* | 1/2020 | Tsuchida | B61L 27/70 |
| 2020/0262300 | A1* | 8/2020 | Tokumaru | B60L 15/40 |
| 2021/0139053 | A1* | 5/2021 | Tokumaru | B61L 25/025 |

OTHER PUBLICATIONS

Written Opinion (PCT/ISA/237) dated Jun. 20, 2017, by the Japan Patent Office as the International Searching Authority for International Application No. PCT/JP2017/011400.

Office Action dated Feb. 5, 2021 issued in corresponding Indian Patent Application No. 201927036597 (5 pages).

* cited by examiner

FIG.7

| PATTERN | DETERMINED TRAIN STOP POSITION X | VEHICLE DOOR TO BE OPENED/CLOSED | VEHICLE DOOR NOT TO BE OPENED/CLOSED |
|---|---|---|---|
| 1 | 3m<X≤6m | 1-3,2-1,···,3-2,3-3 | 1-1,1-2 |
| 2 | 0m<X≤3m | 1-2,1-3,···,3-2,3-3 | 1-1 |
| 3 | 0m | 1-1,1-2,···,3-2,3-3 | None |
| 4 | -3m≤X<0m | 1-1,1-2,···,3-1,3-2 | 3-3 |
| 5 | -6m≤X<3m | 1-1,1-2,···,2-3,3-1 | 3-2,3-3 |

FIG.8

| PATTERN | VEHICLE DOOR INFORMATION | PLATFORM-DOOR TO BE OPENED/CLOSED | PLATFORM-DOOR NOT TO BE OPENED/CLOSED |
|---|---|---|---|
| 1 | a | 1-1,1-2,···,2-3,3-1 | 3-2,3-3 |
| 2 | b | 1-1,1-2,···,3-1,3-2 | 3-3 |
| 3 | c | 1-1,1-2,···,3-2,3-3 | None |
| 4 | d | 1-2,1-3,···,3-2,3-3 | 1-1 |
| 5 | e | 1-3,2-1,···,3-2,3-3 | 1-1,1-2 |

ON-BOARD CONTROL APPARATUS AND PLATFORM-DOOR CONTROL SYSTEM

FIELD

The present invention relates to a technique for opening vehicle doors of a train and platform doors at a station.

BACKGROUND

In recent years, platform doors are installed more often on the platforms of the stations. When the positions of all the vehicle doors of a train entering the platform correspond with the positions of the platform doors, the vehicle doors and the platform doors are opened/closed. In order that the positions of all the vehicle doors of a train correspond with the positions of the platform doors, the train needs to be stopped at a predetermined position on the platform of a station.

For the technique disclosed in Patent Literature 1, if a train cannot stop at a predetermined position on the platform of a station, but has stopped past a predetermined position on the platform of a station, for example, the train undergoes backward inching, such that the train moves backward to the predetermined position.

CITATION LIST

Patent Literature

Patent Literature 1: Japanese Patent Application Laid-open No. 2002-67958

SUMMARY

Technical Problem

Unfortunately, Patent Literature 1 mentioned above poses a problem of requiring a long time before opening the vehicle doors as the backward inching is needed to move the train back to the predetermined position.

The present invention has been achieved to solve the above problem, and an object of the present invention is to open vehicle doors in a shorter time than conventionally required, when a train does not stop at a predetermined position on the platform of a station.

Solution to Problem

According to a first aspect of the invention, an on-board control apparatus provided in a train, the apparatus comprising: a ground-coil information storage unit to store therein information on a ground coil located on a track on which the train runs; a train-position detection unit to detect a position of the train; a train stop-position specification unit to determine a train stop position on a basis of information on the ground coil stored in the ground-coil information storage unit, and train position information detected by the train-position detection unit; a vehicle-door specification unit to determine a vehicle door of the train to be opened/closed, on a basis of the determined train stop position; and a vehicle-door information output unit to output determined vehicle door information of the train.

According to a second aspect of the invention, a platform-door control system comprising: an on-board control apparatus provided in a train and including: a ground-coil information storage unit to store therein information on a ground coil located on a track on which the train runs; a train-position detection unit to detect a position of the train; a train stop-position specification unit to determine a train stop position on a basis of information on the ground coil stored in the ground-coil information storage unit, and train position information detected by the train-position detection unit; a vehicle-door specification unit to determine a vehicle door of the train to be opened/closed, on a basis of the determined train stop position specified; and a vehicle-door information output unit to output determined vehicle door information of the train; and a platform-door control apparatus to receive the vehicle door information output from the vehicle-door information output unit, and control platform doors installed at a station.

Advantageous Effects of Invention

According to the invention, an on-board control apparatus provided in a train, the apparatus comprising: a ground-coil information storage unit to store therein information on a ground coil located on a track on which the train runs; a train-position detection unit to detect a position of the train; a train stop-position specification unit to determine a train stop position on a basis of information on the ground coil stored in the ground-coil information storage unit, and train position information detected by the train-position detection unit; a vehicle-door specification unit to determine a vehicle door of the train to be opened/closed, on a basis of the determined train stop position; and a vehicle-door information output unit to output determined vehicle door information of the train. As a result, in a case where the train does not stop at a predetermined position on the platform of a station, the vehicle doors can be opened in a shorter time than conventionally required.

According to the invention, a platform-door control system comprising: an on-board control apparatus provided in a train and including: a ground-coil information storage unit to store therein information on a ground coil located on a track on which the train runs; a train-position detection unit to detect a position of the train; a train stop-position specification unit to determine a train stop position on a basis of information on the ground coil stored in the ground-coil information storage unit, and train position information detected by the train-position detection unit; a vehicle-door specification unit to determine a vehicle door of the train to be opened/closed, on a basis of the determined train stop position specified; and a vehicle-door information output unit to output determined vehicle door information of the train; and a platform-door control apparatus to receive the vehicle door information output from the vehicle-door information output unit, and control platform doors installed at a station. As a result, in a case where the train does not stop at a predetermined position on the platform of a station, the vehicle doors can be opened in a shorter time than conventionally required.

BRIEF DESCRIPTION OF DRAWINGS

FIG. 7 is a diagram illustrating an example of a vehicle door opening/closing pattern in the platform-door control system according to the first embodiment.

FIG. 8 is a diagram illustrating an example of a platform door opening/closing pattern in the platform-door control system according to the first embodiment.

DESCRIPTION OF EMBODIMENTS

First Embodiment

Figure 1:
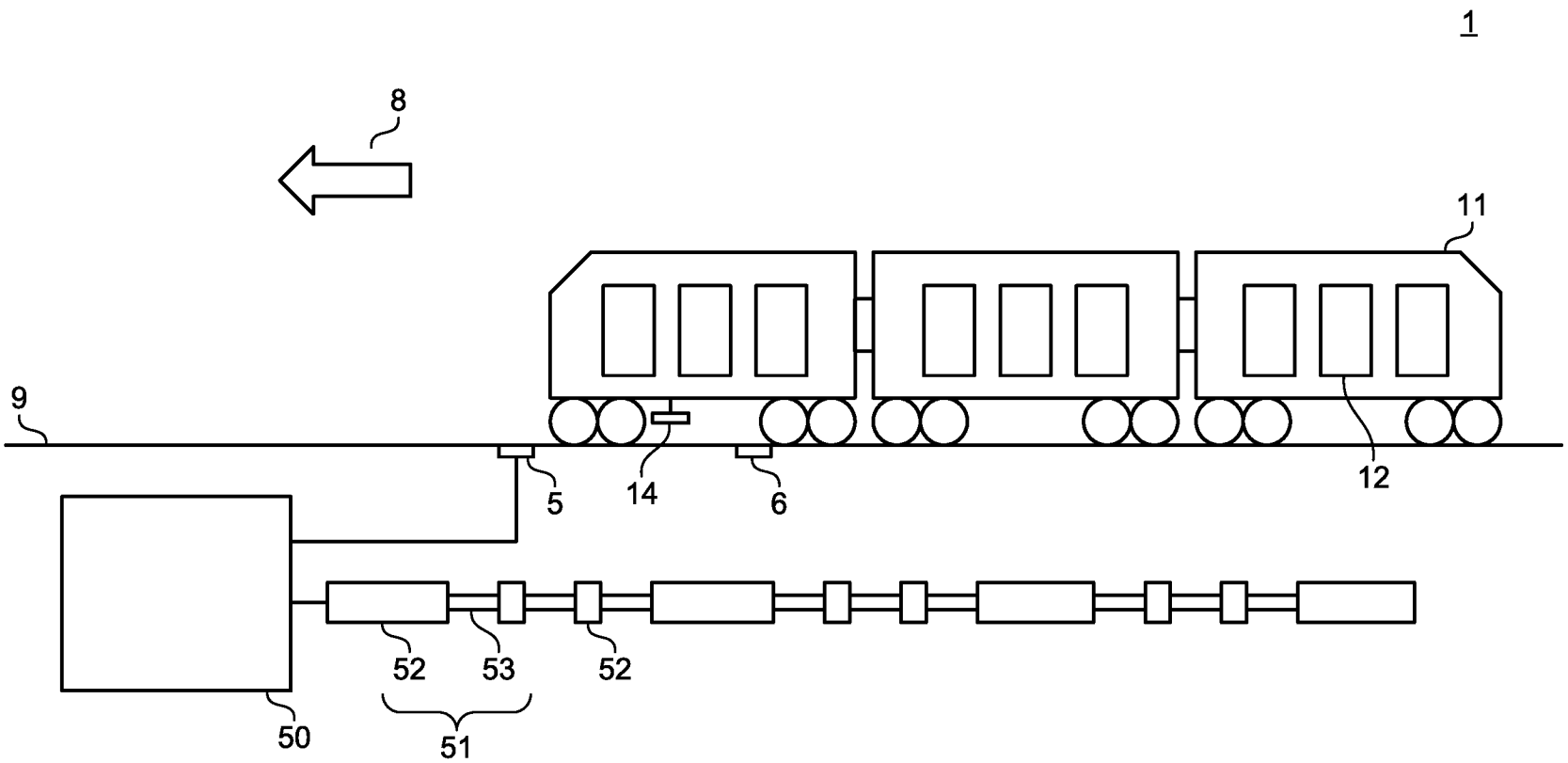
FIG. 1 is a diagram illustrating a configuration of a platform-door control system according to a first embodiment.

FIG. 1 is a diagram illustrating a configuration of a platform-door control system 1 according to a first embodiment of the present invention. The platform-door control system 1 illustrated in FIG. 1 includes a platform-door device 51 installed on the platform of a station, a platform-door control apparatus 50 that controls the platform-door device 51, and an on-board control apparatus (not illustrated) installed in a train 11.

A track 9 is a structure on the roadbed on which the train 11 runs. Ground coils are installed on the track 9 and spaced apart from each other. An ID (ground coil information) is set for each of the ground coils. In FIG. 1, a first ground coil 5 (a ground coil P0) is installed at a predetermined train stop position. A second ground coil 6 (a ground coil P1) is installed before the ground coil P0 installed at the train stop position in the traveling direction of the train 11 (the direction of an arrow 8 in FIG. 1).

The train 11 includes a pickup coil 14 capable of communicating with the ground coils installed on the track 9, and a vehicle-door opening/closing unit 12 through which passengers board and deboard the train 11.

The platform-door device 51 is installed in order to prevent passengers at a station from falling onto the railway tracks. The platform-door device 51 is defined by a platform-door pocket 52 fixedly installed on the platform of a station, and a platform-door opening/closing unit 53 that is openable/closable. The platform-door device 51 operates in conjunction with the doors of the train 11 when this train has stopped at a station. When the train 11 stops at a predetermined position, the platform-door opening/closing unit 53 and the vehicle-door opening/closing unit 12 of the train 11 are opened/closed, thereby allowing passengers to board and deboard the train 11.

The platform-door control apparatus 50 monitors the state of the platform-door device 51 and the stop position of the train 11, and controls the platform-door opening/closing unit 53 of the platform-door device 51 such that the platform-door opening/closing unit 53 is opened/closed. The platform-door control apparatus 50 is connected to the ground coil P0.

Opening/closing operations of the platform-door device 51 are described below. When the train 11 stops at a predetermined stop position, the position of the pickup coil 14 overlaps the position of the ground coil P0. A positional relation that allows the pickup coil 14 positioned directly above a ground coil to communicate with the ground coil is expressed as "the position of the pickup coil 14 overlaps the position of the ground coil". When it is determined that the train 11 stops with the position of the pickup coil 14 overlapping the position of the ground coil P0, it becomes possible for the vehicle-door opening/closing unit 12 and the platform-door opening/closing unit 53 to be opened in conjunction with each other. For example, when it is determined that the train 11 stops at a predetermined stop position, the train 11 transmits a platform-door opening command signal through the pickup coil 14 and the ground coil P0 to the platform-door control apparatus 50, such that the platform-door opening/closing unit 53 is opened. Thereafter, the platform-door control apparatus 50 transmits a reply signal through the ground coil P0 and the pickup coil 14 to the train 11. When the train 11 receives the reply signal, the vehicle-door opening/closing unit 12 is opened, thereby allowing passengers to board and deboard the train 11.

Figure 2:
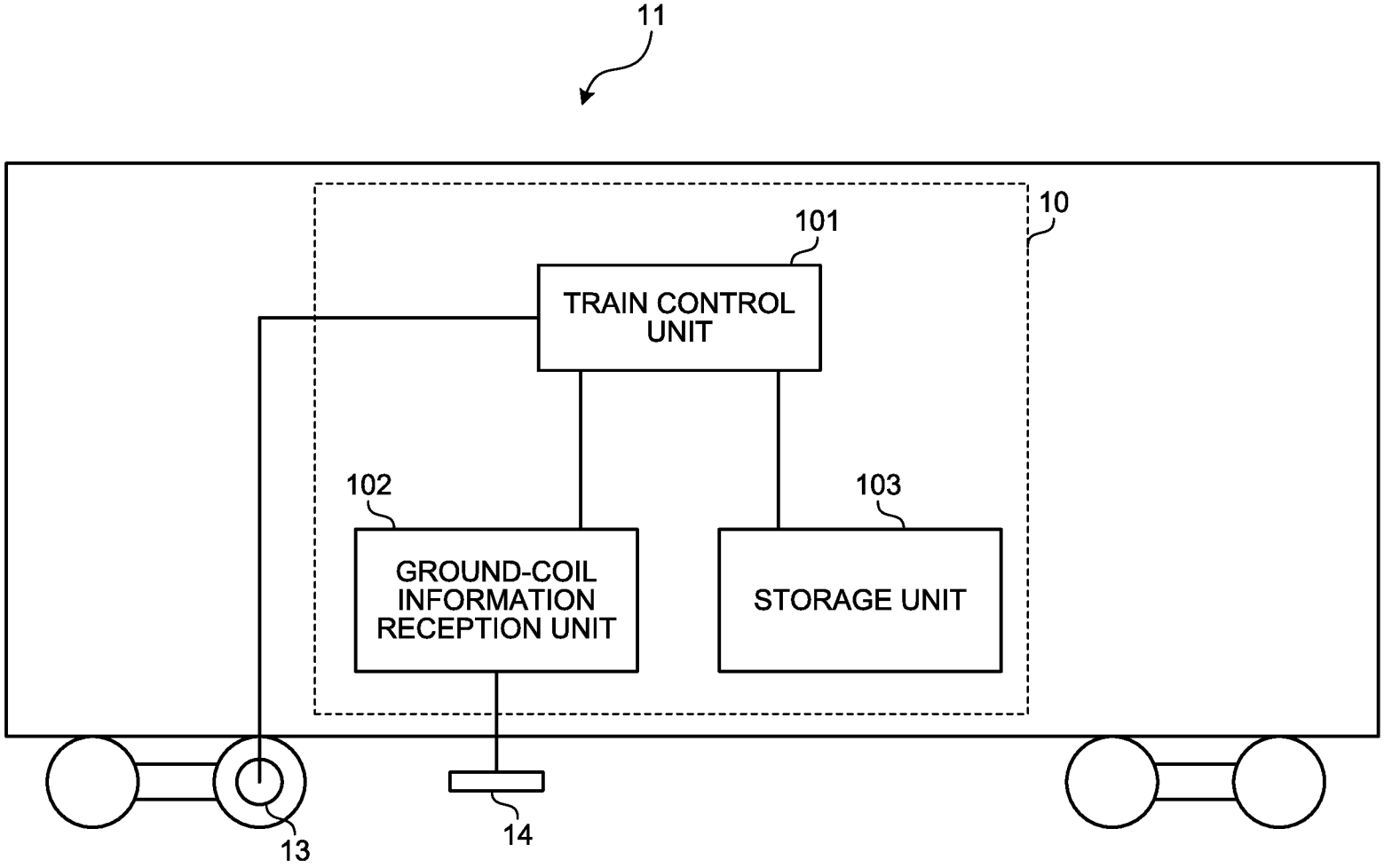
FIG. 2 is a diagram illustrating a configuration of a vehicle in the platform-door control system according to the first embodiment.

FIG. 2 is a diagram illustrating a configuration of a vehicle of the train 11 in the platform-door control system 1 according to the first embodiment. Although FIG. 2 only illustrates the devices necessary for explaining the platform-door control system 1 according to the first embodiment, the train 11 may incorporate other devices and functions.

The train 11 illustrated in FIG. 2 includes an on-board control apparatus 10 installed in the train 11, the pickup coil 14 provided on the outer surface of the bottom of the vehicle and capable of communicating with a ground coil as the vehicle approaches the ground coil, and a rate generator 13 provided on the axle of the train 11. The on-board control apparatus 10 is connected to the rate generator 13 and the pickup coil 14. The on-board control apparatus 10 includes a train control unit 101 connected to the rate generator 13, a ground-coil information reception unit 102 connected to the train control unit 101 and the pickup coil 14, and a storage unit 103 connected to the train control unit 101.

The storage unit 103 has an on-board database (not illustrated) stored therein. The on-board database stores therein information (track information) on the track 9 on which the train 11 runs. The information on the track 9 includes ground-coil installation distance information in kilometers (ground-coil position information).

The pickup coil 14 detects an ID of the ground coil as the pickup coil 14 passes over a ground coil (as the pickup coil 14 overlaps the ground coil). This ID, which is ground coil information, is received by the ground-coil information reception unit 102. This ground coil information is output from the ground-coil information reception unit 102 to the train control unit 101.

The rate generator 13 generates pulses in accordance with the rotational speed of the wheels to calculate and output the movement amount and speed of the corresponding train to the train control unit 101.

The train control unit 101 includes a train-position detection unit 104 which is not illustrated in FIG. 2, but is described later. The train-position detection unit 104 detects the position of the corresponding train. The train-position detection unit 104 calculates the position of the corresponding train on the basis of: the movement amount of the corresponding train output from the rate generator 13; and the ground-coil position information stored in the storage unit 103. The calculated position of the corresponding train is treated as train position information. The train position information includes distance information in kilometers, inbound and outbound track information, and platform-number information within the station building. Train speed information indicating the speed of the corresponding train is output along with the movement amount of the corresponding train from the rate generator 13 to the train control unit 101.

The train-position detection unit 104 detects the position of a ground coil on the basis of the ground coil information from the ground-coil information reception unit 102, and defines this position of the ground coil as a reference position. The train control unit 101 counts the number of pulses generated by power generated by the rate generator 13, and uses the wheel diameter and the number of power generation pulses per revolution to thereby calculate a movement distance. The reference position described above is combined with the calculated movement distance to determine an absolute position of the corresponding train on the track 9.

Next, descriptions are given of a case where a train stops at a predetermined position in a station or the like. The train control unit 101 continuously detects the position of the corresponding train and the train speed in a given cycle, and generates a decelerating speed check pattern such that the corresponding train stops at a train stop position stored in advance in the storage unit 103. The train control unit 101 detects the current position and the train speed in a given cycle. Comparing the detected current position and train speed with the speed check pattern, the train control unit 101 adjusts a brake force, such that the train control unit 101 decelerates the corresponding train in accordance with the speed check pattern. When the train position is accurately detected, and the corresponding train responds correctly to a brake command from the train control unit 101 and is decelerated by a determined brake force, it becomes possible for the corresponding train to stop at a predetermined position in a station or the like.

Unfortunately, in some case, the train position is not accurately detected if the wheel slip or the skidding occurs after the train 11 travels past the ground coil P1 provided immediately before the ground coil P0 provided at a predetermined train stop position in the traveling direction of the train 11.

In some case, also, the corresponding train fails to correctly respond to a brake command from the train control unit 101, with the result that the corresponding train is not decelerated by a determined brake force. In this case, the corresponding train is not decelerated in accordance with the speed check pattern. If the deceleration of the corresponding train does not follow the speed check pattern, the train control unit 101 changes the brake command to control the brake force such that the deceleration follows the speed check pattern. However, a significant difference between a brake command from the train control unit 101 and the actual brake force can make it impossible for the train control unit 101 to control the brake force such that the deceleration follows the speed check pattern.

In cases such as where the train position cannot be accurately detected, or where the train 11 cannot correctly respond to a brake command from the train control unit 101, the train 11 cannot stop at a predetermined train stop position, but stops short of the predetermined train stop position in the traveling direction of the train 11, or stops past the predetermined train stop position in the traveling direction of the train 11. In these cases, the position of the pickup coil 14 does not overlap the position of the ground coil P0. As a result, the doors of the platform-door device 51 installed in a station and the doors of the train 11 cannot be opened/closed when the train stops at the station. To address this problem, an inching process of moving the train 11 forward or backward from the stop position is conventionally needed.

Figure 3:
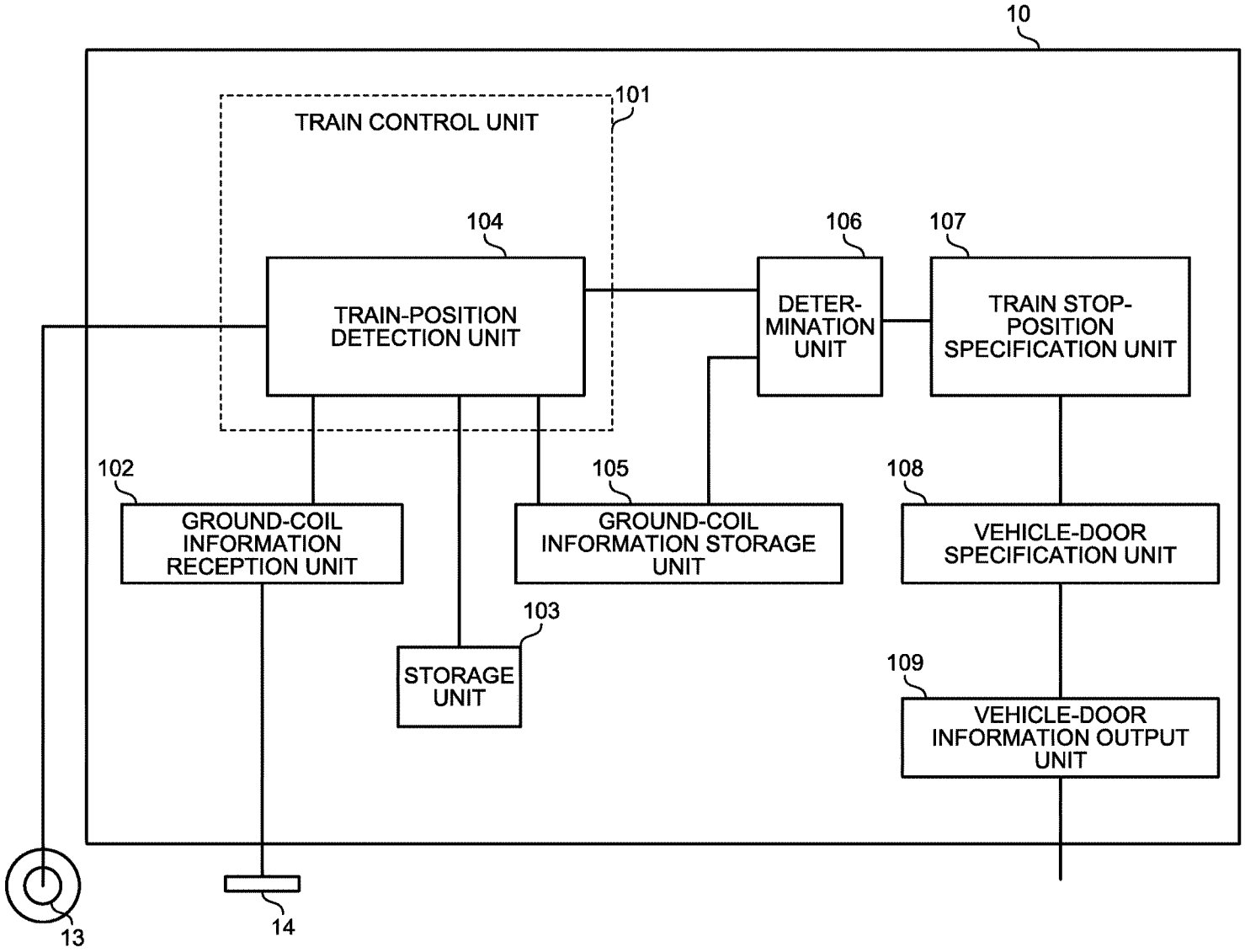
FIG. 3 is a diagram illustrating a configuration of an on-board control apparatus in the platform-door control system according to the first embodiment.

FIG. 3 is a diagram illustrating a configuration of the on-board control apparatus 10 in the train 11 in the platform-door control system 1 according to the first embodiment. Although FIG. 3 illustrates only the devices necessary for explaining the platform-door control system 1 according to the first embodiment, the on-board control apparatus 10 may incorporate other devices and functions.

The on-board control apparatus 10 illustrated in FIG. 3 includes the ground-coil information reception unit 102, a ground-coil information storage unit 105, the train-position detection unit 104, a determination unit 106, a train stop-position specification unit 107, a vehicle-door specification unit 108, and a vehicle-door information output unit 109. The ground-coil information reception unit 102 is connected to the pickup coil 14. The ground-coil information storage unit 105 stores ground coil information therein. The train-position detection unit 104 is connected to the rate generator 13, to the ground-coil information reception unit 102, and to the ground-coil information storage unit 105. The determination unit 106 is connected to the train-position detection unit 104 and to the ground-coil information storage unit 105. The train stop-position specification unit 107 is connected to the determination unit 106. The vehicle-door specification unit 108 is connected to the train stop-position specification unit 107. The vehicle-door information output unit 109 is connected to the vehicle-door specification unit 108 and is connected to outside of the on-board control apparatus 10.

The ground-coil information reception unit 102 receives information transmitted from a ground coil through the pickup coil 14.

The ground-coil information storage unit 105 stores ground coil-related information therein in advance. The ground coil-related information includes ground-coil installation distance information in kilometers (ground-coil position information). The ground-coil information storage unit 105 may be configured separately from the storage unit 103 described above, or the storage unit 103 may include the ground-coil information storage unit 105.

The train-position detection unit 104 is a part of the train control unit 101, as described above. The train-position detection unit 104 calculates the position of the corresponding train on the basis of: the movement amount of the corresponding train output from the rate generator 13; and the ground-coil position information stored in the ground-coil information storage unit 105.

The determination unit 106 detects, from train speed information output from the train control unit 101, whether the corresponding train has stopped. For example, when the train speed information indicates a speed equal to or lower than 0.5 km/h, the determination unit 106 detects that the corresponding train has stopped. When the determination unit 106 detects that the corresponding train has stopped, the determination unit 106 determines, on the basis of most recently received ground coil information, whether the corresponding train has passed a predetermined train stop position.

The train stop-position specification unit 107 determines the stop position of the corresponding train on the basis of: the train position information calculated by the train-position detection unit 104; and the ground-coil position information stored in the ground-coil information storage unit 105. The train stop-position specification unit 107 may have a function of the determination unit 106. The determined train stop position is output to the vehicle-door specification unit 108.

On the basis of the train stop position determined by the train stop-position specification unit 107, the vehicle-door specification unit 108 determines which vehicle-door opening/closing unit 12 needs to be opened/closed among the vehicle-door opening/closing units 12 of the corresponding train, thereby providing vehicle door information to that effect. The determined vehicle door information is output to the vehicle-door information output unit 109.

The vehicle-door information output unit 109 outputs, to outside of the on-board control apparatus 10, the vehicle door information output from the vehicle-door specification unit 108, which information is indicative of the doors determined to be opened/closed. This makes it possible to open/close the vehicle-door opening/closing unit 12 corresponding to the output vehicle door information. In a case where the platform-door device 51 is installed, the determined vehicle door information is output through the pickup coil 14 and the ground coil P0 to the platform-door control apparatus 50.

Figure 4:
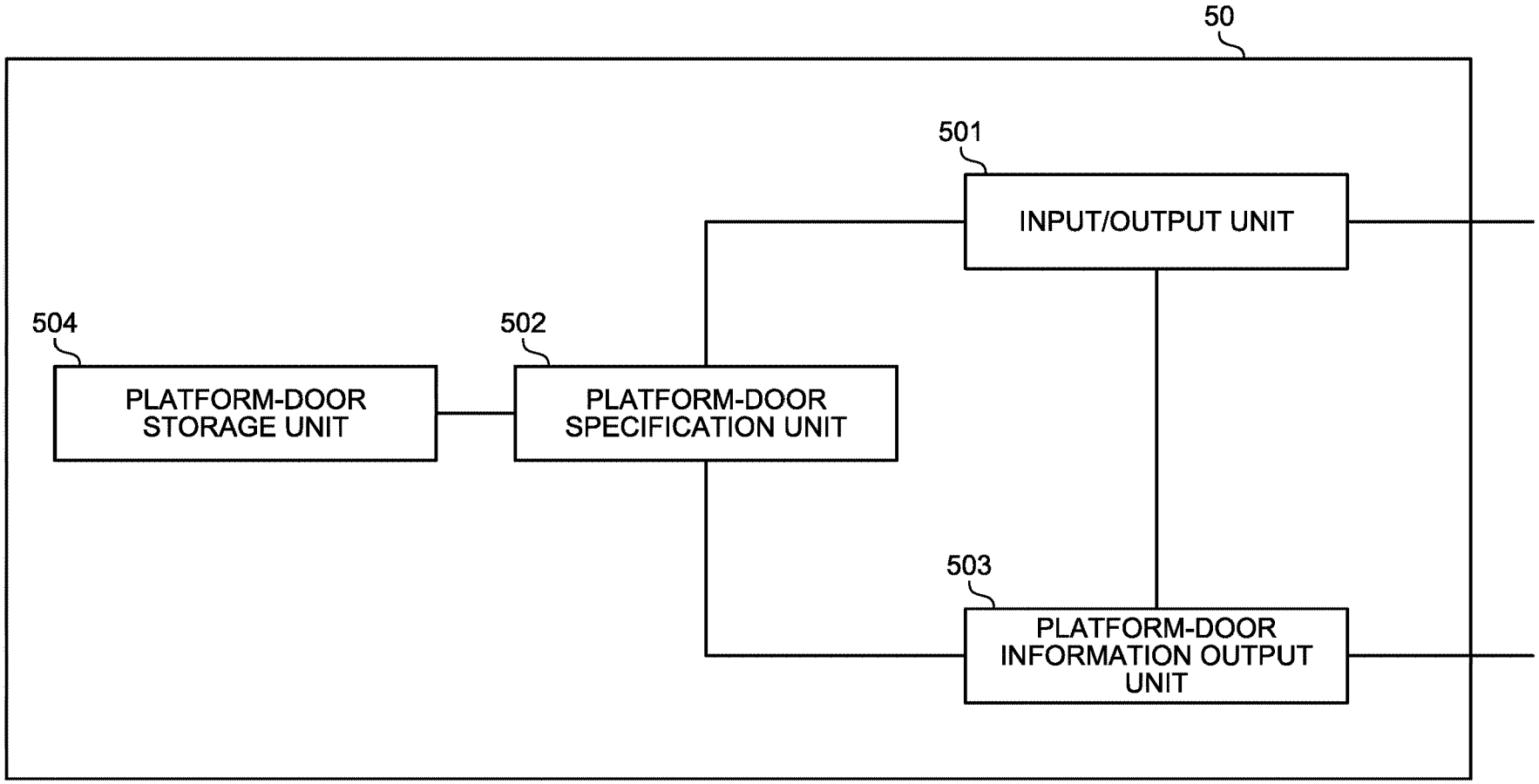
FIG. 4 is a diagram illustrating a configuration of a platform-door control apparatus in the platform-door control system according to the first embodiment.

FIG. 4 is a diagram illustrating a configuration of the platform-door control apparatus 50 in the platform-door control system 1 according to the first embodiment. Although FIG. 4 only illustrates the devices necessary for explaining the platform-door control system 1 according to the first embodiment, The platform-door control apparatus 50 may incorporate other devices and functions.

The platform-door control apparatus 50 includes an input/output unit 501, a platform-door specification unit 502, a platform-door information output unit 503, and a platform-door storage unit 504. The platform-door specification unit 502 is connected to the input/output unit 501. The platform-door information output unit 503 is connected to the platform-door specification unit 502. The platform-door storage unit 504 is connected to the platform-door specification unit 502.

The input/output unit 501 is connected to the ground coil P0. Vehicle door information output from the train 11 is input to the input/output unit 501. The input vehicle door information is output to the platform-door specification unit 502.

The platform-door specification unit 502 determines which platform-door opening/closing unit 53 needs to be opened/closed among the platform-door opening/closing units 53 of the platform-door device 51 connected to the platform-door control apparatus 50. The determined platform door information is output to the platform-door information output unit 503.

The platform-door information output unit 503 outputs, to the platform-door device 51, the platform door information output from the platform-door specification unit 502, which information is indicative of the platform doors determined to be opened/closed. This makes it possible to open/close the determined platform-door opening/closing unit 53.

When it becomes possible to open/close the platform-door opening/closing unit 53, the input/output unit 501 outputs a reply signal to the on-board control apparatus 10.

Next, operations of the platform-door control system 1 according to the first embodiment are described. In the descriptions hereinafter, a predetermined train stop position is referred to as "target train-stop position". The target train-stop position indicates the position of the ground coil P0 unless otherwise specified. The descriptions are made below as to, by way of example, the train 11 made up of three vehicles each including three vehicle-door opening/closing units 12. Each vehicle of the train may any number of vehicle-door opening/closing units 12, and the train 11 may be made up of any number of vehicles. In this example, the three vehicles are referred to as "first car", "second car", and "third car", respectively, in that order from the front in the traveling direction of the train 11. The three vehicle-door opening/closing units 12 of each vehicle are referred to as "first vehicle-door opening/closing unit", "second vehicle-door opening/closing unit", and "third vehicle-door opening/closing unit", respectively, in that order from the front in the travelling direction of the train 11. The platform-door device 51 includes any number of the platform-door opening/closing units 53. In this example, three leading platform-door opening/closing units 53 in the traveling direction of the train 11 are grouped into a single group, and there are nine platform-door opening/closing units 53 from the front in the traveling direction of the train 11. That is, because each group is made up of three platform-door opening/closing units 53, there are three groups in total. In each of the groups, the three platform-door opening/closing units 53 are referred to as "first platform-door opening/closing unit", "second platform-door opening/closing unit", and "third platform-door opening/closing unit", respectively, in that order from the front.

Descriptions are given of: case (1) where the train has stopped past the target train-stop position; and case (2) where the train has stopped before the target train-stop position.

Figure 5:
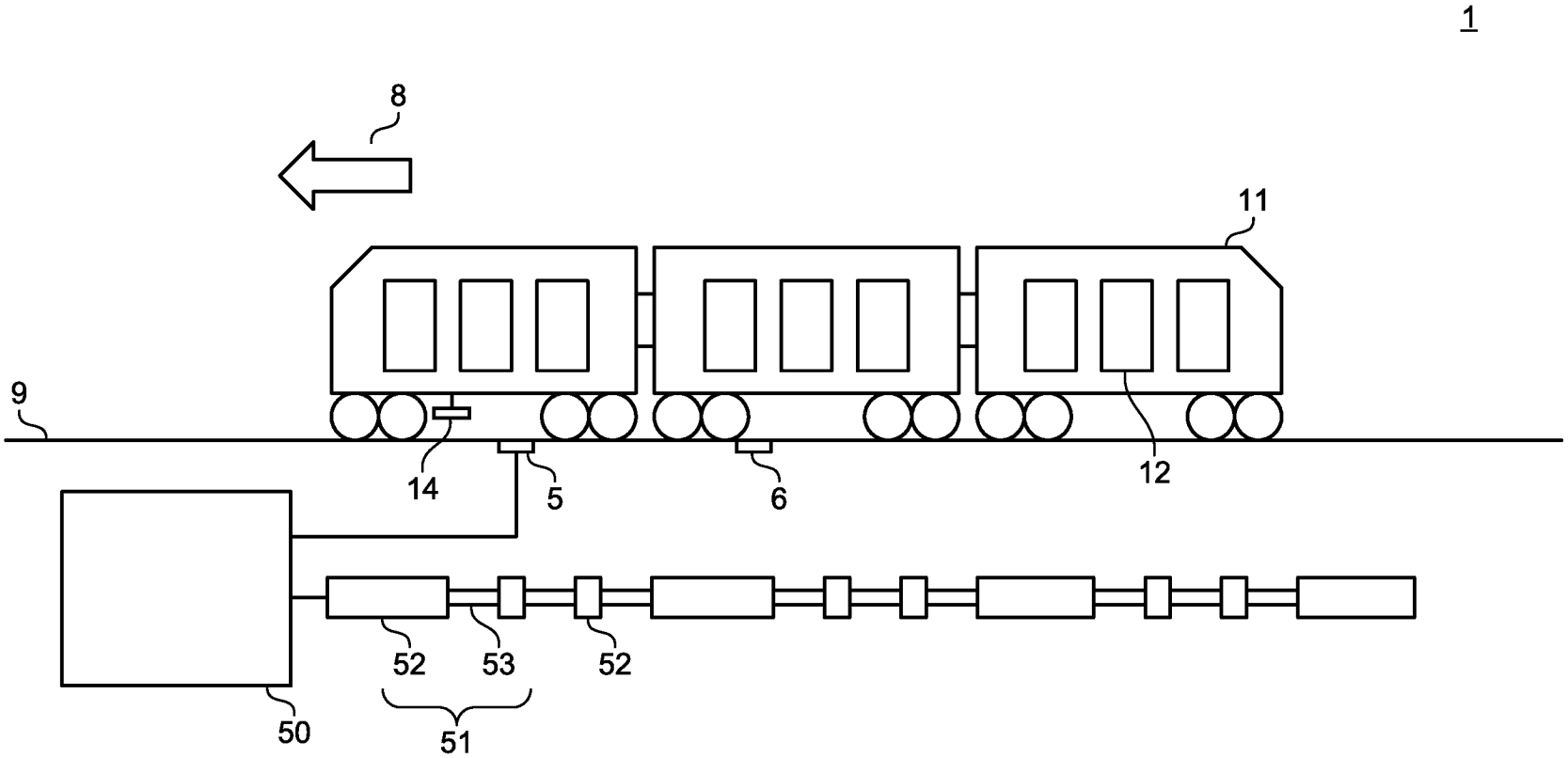
FIG. 5 is a diagram illustrating an example of the configuration of the platform-door control system according to the first embodiment.

First, case (1) is described. FIG. 5 is a diagram illustrating an example of the configuration of the platform-door control system according to the first embodiment. FIG. 5 illustrates the train 11 having stopped past a predetermined stop position. The train-position detection unit 104 calculates the position of the corresponding train on the basis of: the movement amount of the corresponding train output from the rate generator 13; and the ground-coil position information of the ground coil P0 stored in the ground-coil information storage unit 105. The train-position detection unit 104 then outputs train position information, which is the calculated position of the corresponding train, to the train stop-position specification unit 107.

The determination unit 106 detects that the corresponding train has stopped in which case the determination unit 106 determines that the corresponding train has stopped past the target train-stop position as the most recently received ground coil information is a signal from the ground coil P0.

On the basis of: the train position information calculated by the train-position detection unit 104; and the ground-coil position information on the ground coil P0 stored in the ground-coil information storage unit 105, the train stop-position specification unit 107 determines how far past the ground coil P0 the corresponding train has stopped. For example, the train stop-position specification unit 107 determines that the corresponding train has stopped three meters past the ground coil P0. The determined train stop position is output to the vehicle-door specification unit 108.

On the basis of the determined train stop position, the vehicle-door specification unit 108 determines which vehicle-door opening/closing unit 12 needs to be opened/closed among the vehicle-door opening/closing units 12 of the corresponding train. For example, when the corresponding train has stopped three meters past the ground coil P0, the vehicle-door specification unit 108 determines that all of the vehicle-door opening/closing units 12 other than the first vehicle-door opening/closing unit 12 of the first car are to be opened/closed, and then outputs vehicle door information to that effect to the vehicle-door information output unit 109.

The vehicle-door information output unit 109 outputs the determined vehicle door information through the pickup coil 14 and the ground coil P0 to the platform-door control apparatus 50.

The platform-door control apparatus 50 receives the vehicle door information output from the train 11, and determines, on the basis of the vehicle door information, the platform-door opening/closing unit 53 to be opened/closed. For example, the platform-door control apparatus 50 determines that all of the platform-door opening/closing units 53 other than the third platform-door opening/closing unit 53 of the third group are to be opened/closed. After the determined platform-door opening/closing units 53 are opened, the determined vehicle-door opening/closing units 12 are opened, thereby allowing passengers to board and deboard the train 11.

In FIG. 5, the position of the first vehicle-door opening/closing unit 12 of the second car overlaps the position of one of the platform-door pockets 52 of the platform-door devices 51 in the traveling direction of the train 11. Similarly, the position of the first vehicle-door opening/closing unit 12 of the third car overlaps the position of another platform-door pocket 52 of the platform-door device 51 in the traveling direction of the train 11. If the vehicle-door opening/closing unit 12, which overlaps the position of the platform-door opening/closing unit 53, is opened/closed but it is difficult for passengers to board and deboard the train 11 through this opened/closed vehicle-door opening/closing unit 12, such a vehicle-door opening/closing unit 12 need not be determined as a vehicle door to be opened/closed.

Figure 6:
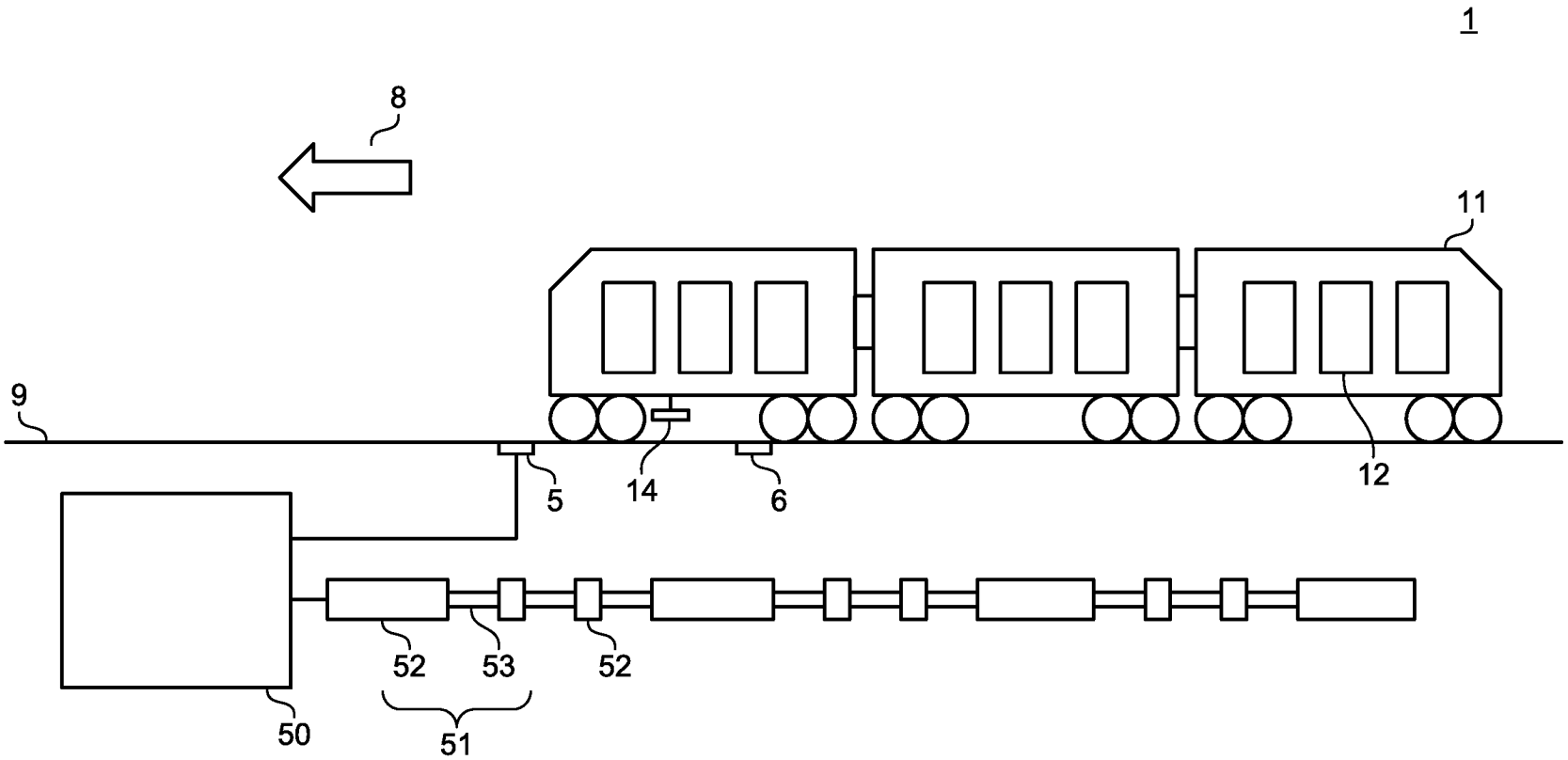
FIG. 6 is a diagram illustrating an example of the configuration of the platform-door control system according to the first embodiment.

Next, case (2) is described. FIG. 6 is a diagram illustrating an example of the configuration of the platform-door control system according to the first embodiment. FIG. 6 illustrates the train 11 having stopped before a predetermined stop position. The train-position detection unit 104 calculates the position of the corresponding train on the basis of: the movement amount of the corresponding train output from the rate generator 13; and the ground-coil position information on the ground coil stored in the ground-coil information storage unit 105. The train-position detection unit 104 then outputs the calculated position of the corresponding train, which is train position information, to the train stop-position specification unit 107.

The determination unit 106 detects that the corresponding train has stopped in which case the determination unit 106 determines that the corresponding train has stopped between the ground coil P1 and the ground coil P0 rather than past the target train-stop position as the most recently received ground coil information is a signal from the ground coil P1, not from the ground coil P0.

On the basis of: the train position information calculated by the train-position detection unit 104; and the ground-coil position information on the ground coil P1 stored in the ground-coil information storage unit 105, the train stop-position specification unit 107 determines how far short of the ground coil P0 the corresponding train has stopped. Specifically, because the ground-coil position information on the ground coil P1, the ground-coil position information on the ground coil P0, and the train position information have been obtained, it is possible to determine how far short of the ground coil P0 the corresponding train has stopped. For example, assume that the distance between the ground coil P0 and the ground coil P1 is 10 meters. In this case, when the corresponding train has stopped seven meters past the ground coil P1, the train stop-position specification unit 107 determines that the corresponding train has stopped three meters short of the ground coil P0. The determined train stop position is output to the vehicle-door specification unit 108.

On the basis of the determined train stop position, the vehicle-door specification unit 108 determines which vehicle-door opening/closing unit 12 needs to be opened/closed among the vehicle-door opening/closing units 12 of the corresponding train. For example, when the corresponding train has stopped three meters short of the ground coil P0, the vehicle-door specification unit 108 determines that all of the vehicle-door opening/closing units 12 other than the third vehicle-door opening/closing unit 12 of the third car are to be opened/closed and then outputs vehicle door information to that effect to the vehicle-door information output unit 109.

The vehicle-door information output unit 109 outputs the determined vehicle door information through the pickup coil 14 and the ground coil P0 to the platform-door control apparatus 50.

The platform-door control apparatus 50 receives the vehicle door information output from the train 11, and determines, on the basis of the vehicle door information, the platform-door opening/closing unit 53 to be opened/closed. For example, the platform-door control apparatus 50 determines that all of the platform-door opening/closing units 53 other than the first platform-door opening/closing unit 53 of the first group are to be opened/closed. After the determined platform-door opening/closing units 53 are opened, the determined vehicle-door opening/closing units 12 are opened, thereby allowing passengers to board and deboard the train 11.

As described above, the platform-door control system 1 according to the first embodiment determines the vehicle-door opening/closing unit 12 to be opened/closed, and the platform-door opening/closing unit 53 to be opened/closed regardless of the stop position of the train 11. This makes it possible to open the vehicle doors and the platform doors in a shorter time than conventionally required.

Next, a description is made below as to determination of the vehicle-door opening/closing unit 12 to be opened/closed. A crew member of the train 11 can perform an operation of opening or not opening a specific vehicle-door opening/closing unit 12, thereby determining which vehicle-door opening/closing unit 12 needs to be opened/closed. The train stop position determined by the train stop-position specification unit 107 may correspond to the vehicle-door opening/closing unit 12 to be opened/closed.

FIG. 7 is a diagram illustrating an example of opening/closing patterns of the vehicle-door opening/closing units 12 of the train 11 stored in the storage unit 103. In FIG. 7, the parameter "determined train stop position X" represents a distance from the ground coil P0. When the train 11 has stopped past the ground coil P0, the determined train stop position X is shown as a positive value, while when the train 11 has stopped short of the ground coil P0, the determined train stop position X is shown as a negative value. The parameter "vehicle door to be opened/closed" represents which vehicle-door opening/closing unit 12 needs to be opened/closed among the vehicle-door opening/closing units 12 of the train 11. The numeral preceding the hyphen indicates the car number. The numeral following the hyphen indicates the door number. For example, "1-3" indicates the third vehicle-door opening/closing unit 12 of the first car. The parameter "vehicle door not to be opened/closed" represents which vehicle-door opening/closing unit 12 needs not to be opened/closed among the vehicle-door opening/closing units 12 of the train 11. "None" indicates that all the vehicle-door opening/closing units 12 are opened/closed. Other notations related to the parameter "vehicle door not to be opened/closed" mean the same as described for the parameter "vehicle door to be opened/closed".

For example, in case (1) described above, the train 11 has stopped three meters past the ground coil P0, leading to X=3. Accordingly, the pattern 2 is selected, such that the first vehicle-door opening/closing unit 12 of the first car is not opened/closed, but the remaining vehicle-door opening/closing units 12 are opened/closed. In case (2) described above, the train 11 has stopped three meters short of the ground coil P0, leading to X=−3. Accordingly, the pattern 4 is selected, such that the third vehicle-door opening/closing unit 12 of the third car is not opened/closed, but the remaining vehicle-door opening/closing units 12 are opened/closed.

The vehicle-door specification unit 108 includes a vehicle-door opening/closing pattern selection unit that selects, from among the opening/closing patterns of the vehicle-door opening/closing units 12 stored in the storage unit 103, an opening/closing pattern corresponding to the train stop position determined by the train stop-position specification unit 107. The vehicle-door specification unit 108 outputs the selected vehicle door opening/closing pattern, which is vehicle door information, to the vehicle-door information output unit 109. The opening/closing patterns of the vehicle-door opening/closing units 12 may be stored in a storage unit other than the storage unit 103.

Next, a description is made below as to determination of the platform doors to be opened/closed. The platform-door control apparatus 50 outputs platform door information corresponding to the vehicle door information output from the train 11. This makes it possible to open/close a specific platform-door opening/closing unit 53.

FIG. 8 is a diagram illustrating an example of the platform door opening/closing patterns stored in the platform-door storage unit 504 illustrated in FIG. 4. In FIG. 8, the parameter "vehicle door information" is vehicle door information output from the train 11. The parameter "platform door to be opened/closed" represents which platform-door opening/closing unit 53 needs to be opened/closed among the platform-door opening/closing units 53 of the platform-door device 51. The numeral preceding the hyphen indicates the group number. The numeral following the hyphen indicates the platform-door number. For example, "1-3" indicates the third platform-door opening/closing unit 53 of the first group. The parameter "platform door not to be opened/closed" represents which platform-door opening/closing unit 53 needs not to be opened/closed among the platform-door opening/closing units 53 of the platform-door device 51. "None" indicates that all the platform-door opening/closing units 53 are opened/closed. Other notations related to the parameter "platform door not to be opened/closed" mean the same as described for the parameter "platform door to be opened/closed".

In a case where vehicle door information b is output from the train 11, the pattern 2 is selected as an opening/closing pattern of the platform doors, such that the third platform-door opening/closing unit 53 of the third group is not opened/closed, but the remaining platform-door opening/closing units 53 are opened/closed.

The platform-door specification unit 502 reads the platform door opening/closing patterns from the platform-door storage unit 504, selects an opening/closing pattern corresponding to the vehicle door information output from the train 11, determines the platform-door opening/closing unit 53 to be opened/closed, and outputs the determined information to the platform-door information output unit 503. The platform door opening/closing patterns may be stored in a storage unit other than the platform-door storage unit 504.

As described above, the on-board control apparatus 10 according to the first embodiment is provided in the train 11, and includes: the ground-coil information storage unit 105 that stores therein information on a ground coil located on the track 9 on which the train 11 runs; the train-position detection unit 104 that detects the position of the train 11; the train stop-position specification unit 107 that determines the train stop position on the basis of information on the ground coil stored in the ground-coil information storage unit 105, and the train position information detected by the train-position detection unit 104; the vehicle-door specification unit 108 that determines the vehicle-door opening/closing unit 12 of the train 11 to be opened/closed, on the basis of the determined train stop position; and the vehicle-door information output unit 109 that outputs the determined vehicle door information on the train 11. As a result, in a case where the train 11 does not stop at a predetermined position on the platform of a station, the vehicle doors can be opened in a shorter time than conventionally required.

The on-board control apparatus 10 according to the first embodiment further includes: the determination unit 106 that determines whether the train 11 has passed a target train-stop position on the basis of the information of the ground coil and the train position information; and a train-stop detection unit that detects that the train 11 has stopped. The information on the ground coil includes first ground coil information on the first ground coil 5 provided at the target train-stop position, and second ground coil information on the second ground coil 6 provided immediately before the first ground coil 5 in the traveling direction of the train 11. When the train-stop detection unit detects that the train 11 has stopped, the determination unit 106 determines, on the basis of the train position information, the first ground coil information, and the second ground coil information, that the train 11 has not passed the target train-stop position as the train 11 is positioned between the position of the first ground coil 5 and the position of the second ground coil 6, and determines the position where the train 11 has stopped, as a train stop position. As a result, in a case where the train 11 does not stop at a predetermined position on the platform of a station, the vehicle doors can be opened in a shorter time than conventionally required.

The on-board control apparatus 10 according to the first embodiment further includes the storage unit 103 storing therein vehicle door opening/closing patterns of the train 11. The vehicle-door specification unit 108 includes: the vehicle-door opening/closing pattern selection unit that selects, from among the vehicle door opening/closing patterns stored in the storage unit 103, a vehicle door opening/closing pattern based on the train stop position determined by the train stop-position specification unit 107; and a vehicle-door opening/closing pattern output unit that outputs the selected vehicle door opening/closing pattern. As a result, in a case where the train 11 does not stop at a predetermined position on the platform of a station, the vehicle doors can be opened in a shorter time than conventionally required.

The platform-door control system 1 according to the first embodiment includes the on-board control apparatus 10 provided in the train 11, and the platform-door control apparatus 50. The on-board control apparatus 10 includes: the ground-coil information storage unit 105 that stores therein information on a ground coil located on the track 9 on which the train 11 runs; the train-position detection unit 104 that detects the position of the train 11; the train stop-position specification unit 107 that determines the train stop position on the basis of information on the ground coil stored in the ground-coil information storage unit 105, and the train position information detected by the train-position detection unit 104; the vehicle-door specification unit 108 that determines the vehicle door of the train 11 to be opened/closed, on the basis of the determined train stop position; and the vehicle-door information output unit 109 that outputs the determined vehicle door information of the train 11. The platform-door control apparatus 50 receives the vehicle door information output from the vehicle-door information output unit 109, and controls platform doors installed at a station. As a result, in a case where the train 11 does not stop at a predetermined position on the platform of a station, the vehicle doors can be opened in a shorter time than conventionally required.

In the platform-door control system 1 according to the first embodiment, the on-board control apparatus 10 includes: the determination unit 106 that determines whether the train 11 has passed a target train-stop position, on the basis of the information on the ground coil and the train position information; and the train-stop detection unit that detects that the train 11 has stopped. The information on the ground coil includes first ground coil information on the first ground coil 5 provided at the target train-stop position, and second ground coil information on the second ground coil 6 provided immediately before the first ground coil 5 in the traveling direction of the train 11. When the train-stop detection unit detects that the train 11 has stopped, the determination unit 106 determines, on the basis of the train position information, the first ground coil information, and the second ground coil information, that the train 11 has not passed the target train-stop position as the train 11 is positioned between the position of the first ground coil 5 and the position of the second ground coil 6, and determines the position where the train 11 has stopped, as a train stop position. As a result, in a case where the train 11 does not stop at a predetermined position on the platform of a station, the vehicle doors can be opened in a shorter time than conventionally required.

In the platform-door control system 1 according to the first embodiment, the on-board control apparatus 10 includes the storage unit 103 storing therein the vehicle door opening/closing patterns of the train 11. The vehicle-door specification unit 108 includes: the vehicle-door opening/closing pattern selection unit that selects, from among the vehicle door opening/closing patterns stored in the storage unit 103, a vehicle door opening/closing pattern based on the train stop position determined by the train stop-position specification unit 107; and the vehicle-door opening/closing pattern output unit that outputs the selected vehicle door opening/closing pattern. As a result, in a case where the train 11 does not stop at a predetermined position on the platform of a station, the vehicle doors can be opened in a shorter time than conventionally required.

In the platform-door control system 1 according to the first embodiment, the platform-door control apparatus 50 includes: the platform-door specification unit 502 that determines the door of the platform doors to be opened/closed; and the platform-door information output unit 503 that outputs information on the platform door determined by the platform-door specification unit 502. The platform-door control apparatus 50 controls opening/closing of the platform doors on the basis of information on the determined platform door output from the platform-door information output unit 503. As a result, in a case where the train 11 does not stop at a predetermined position on the platform of a station, the vehicle doors can be opened in a shorter time than conventionally required.

In the platform-door control system 1 according to the first embodiment, the vehicle-door information output unit 109 outputs the vehicle door opening/closing pattern that is vehicle door information, the platform-door control apparatus 50 includes the platform-door storage unit 504 storing therein the platform door opening/closing patterns, and the platform-door specification unit 502 determines, from the platform-door storage unit 504, the platform door opening/closing pattern corresponding to the vehicle door opening/closing pattern. As a result, in a case where the train 11 does not stop at a predetermined position on the platform of a station, the vehicle doors can be opened in a shorter time than conventionally required.

Second Embodiment

Figure 9:
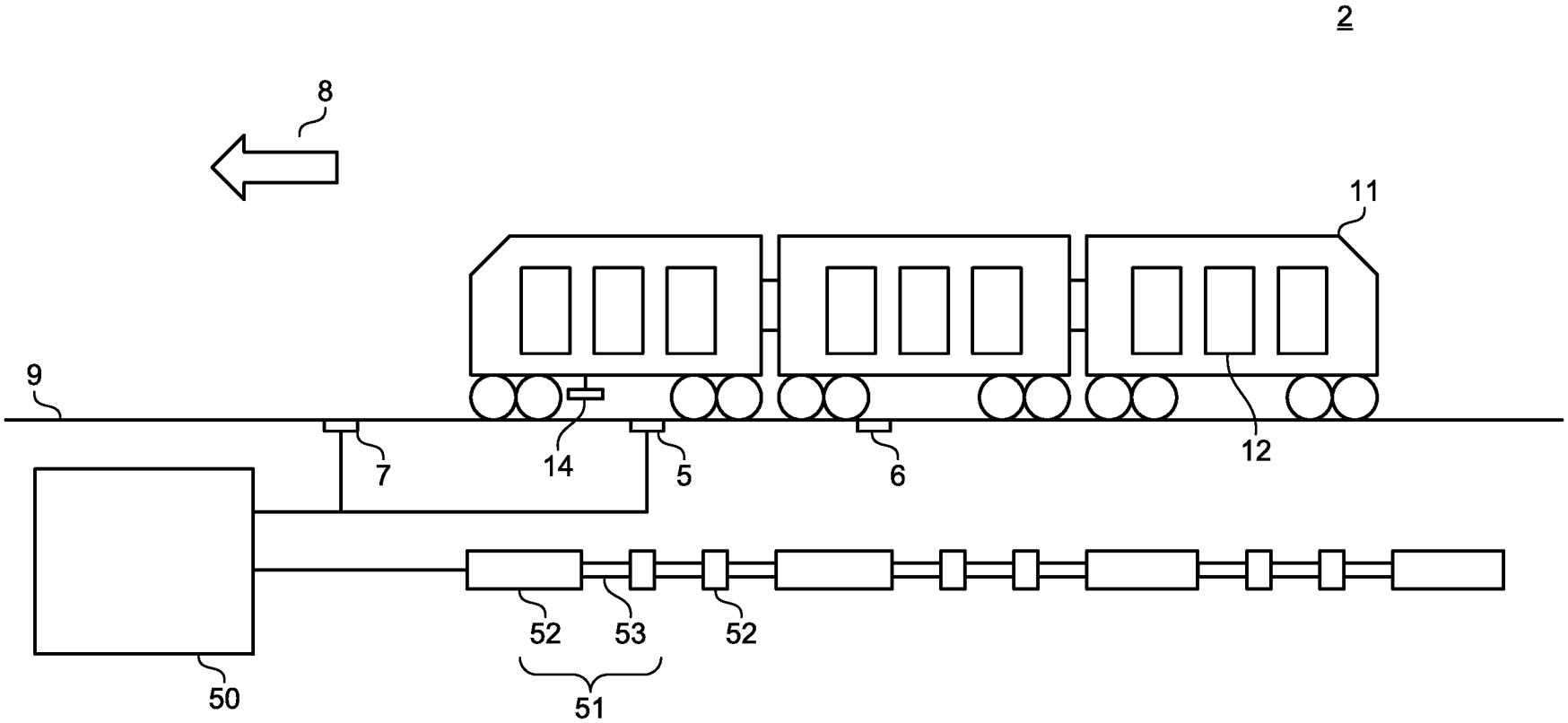
FIG. 9 is a diagram illustrating a configuration of a platform-door control system according to a second embodiment.

FIG. 9 is a diagram illustrating a configuration of a platform-door control system 2 according to a second embodiment. The platform-door control system 2 has a feature that the platform-door control system 2 includes a third ground coil 7 (a ground coil PB) ahead of the ground coil P0 in the traveling direction of the train 11 (the direction of an arrow 8 in FIG. 9). Configurations of respective devices of the second embodiment are identical to those of the first embodiment unless otherwise specified.

The ground coil PB is installed on the track 9 ahead of the ground coil P0 in the traveling direction of the train 11. The distance between the ground coil P0 and the ground coil PB is equivalent to the length of a single vehicle of the train 11. Similarly to the ground coil P0, the ground coil PB is connected to the platform-door control apparatus 50.

Figure 10:
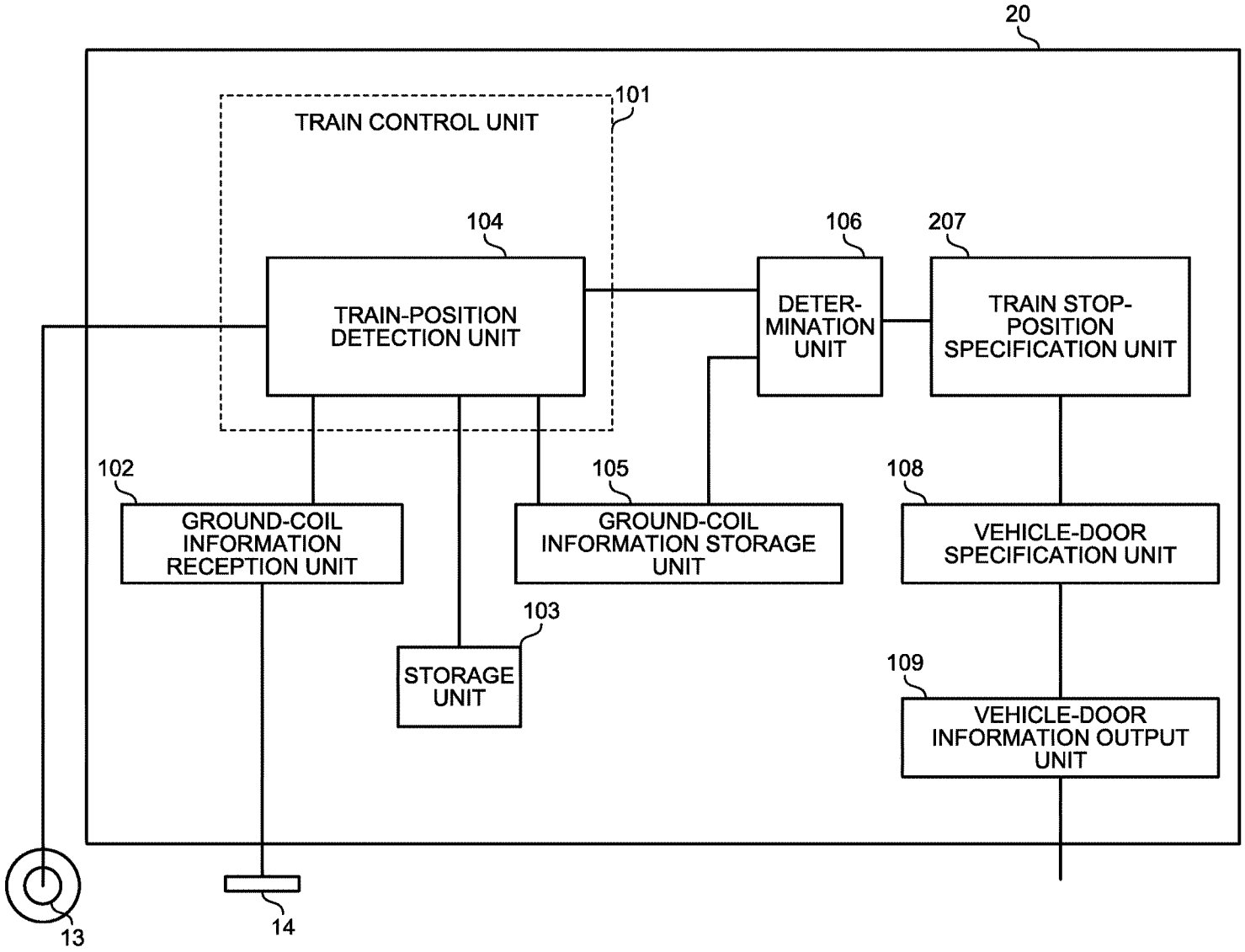
FIG. 10 is a diagram illustrating a configuration of an on-board control apparatus in the platform-door control system according to the second embodiment.

FIG. 10 is a diagram illustrating a configuration of an on-board control apparatus 20 of the train 11 in the platform-door control system 2 according to the second embodiment.

Operations of the platform-door control system 2 according to the second embodiment are described below. Descriptions in the operations of the second embodiment are the same as those of the first embodiment unless otherwise specified.

The train-position detection unit 104 calculates the position of the corresponding train on the basis of: the movement amount of the corresponding train output from the rate generator 13; and the ground-coil position information on the ground coil P0 stored in the ground-coil information storage unit 105. The train-position detection unit 104 then outputs, to a train stop-position specification unit 207, train position information which is the calculated position of the corresponding train.

The determination unit 106 detects, from train speed information output from the train control unit 101, whether the corresponding train has stopped. For example, when the train speed information indicates a speed higher than 0.5 km/h, the determination unit 106 determines that the corresponding train has not stopped. When the determination unit 106 detects that the corresponding train has not stopped, the determination unit 106 determines, on the basis of most recently received ground coil information, whether the corresponding train has passed the target train-stop position. The determination unit 106 detects that the corresponding train has not stopped in which case the determination unit 106 determines that the corresponding train has passed the target train-stop position as the most recently received ground coil information is a signal from the ground coil P0.

When the determination unit 106 detects that the corresponding train has not stopped and thus determines that the corresponding train has passed the target train-stop position, then the train stop-position specification unit 207 determines the stop position of the corresponding train as a position of the ground coil PB, on the basis of: the train position information calculated by the train-position detection unit 104; the ground-coil position information on the ground coil P0; and the ground-coil position information on the ground coil PB stored in the ground-coil information storage unit 105.

When the train stop-position specification unit 207 determines the stop position of the corresponding train as a position of the ground coil PB, the train control unit 101 newly generates a speed check pattern such that the corresponding train can stop at the position of the ground coil PB. Then the train control unit 101 decelerates the corresponding train in accordance with the newly generated speed check pattern to thereby stop the corresponding train at the position of the ground coil PB. At this time, the position of the pickup coil 14 of the corresponding train overlaps the position of the ground coil PB.

The train stop position determined by the train stop-position specification unit 207 is output to the vehicle-door specification unit 108.

On the basis of the determined train stop position, the vehicle-door specification unit 108 determines which vehicle door needs to be opened/closed among the vehicle-door opening/closing units 12 of the corresponding train. Because the distance between the ground coil P0 and the ground coil PB is equivalent to the length of a single vehicle of the train 11, the vehicle-door specification unit 108 determines that the vehicle-door opening/closing units 12 of the first car are not to be opened/closed, but the vehicle-door opening/closing units 12 of the second and third cars are to be opened/closed, and outputs vehicle door information to that effect to the vehicle-door information output unit 109.

The vehicle-door information output unit 109 outputs the determined vehicle door information through the pickup coil 14 and the ground coil PB to the platform-door control apparatus 50.

The platform-door control apparatus 50 receives the vehicle door information output from the train 11, and determines, on the basis of the vehicle door information, the platform-door opening/closing unit 53 to be opened/closed. For example, the platform-door control apparatus 50 determines all of the platform-door opening/closing units 53 other than the platform-door opening/closing units 53 of the third group are to be opened/closed. After the platform doors of the determined platform-door opening/closing units 53 are opened, the determined vehicle-door opening/closing units 12 are opened, thereby allowing passengers to board and deboard the train 11.

In the second embodiment, the distance between the ground coil P0 and the ground coil PB is equivalent to the length of a single vehicle of the train 11. However, the distance is not limited thereto. Since the ground-coil position information on the ground coil P0 and the ground-coil position information on the ground coil PB are stored in advance in the ground-coil information storage unit 105, it is possible to calculate the distance between the ground coil P0 and the ground coil PB. It is only required that the train stop-position specification unit 207 determine the train stop position corresponding to the calculated distance.

The on-board control apparatus 20 according to the second embodiment includes the determination unit 106 that determines whether the train 11 has passed the target train-stop position, on the basis of the information on the ground coil and the train position information. The information on the ground coil includes first ground coil information on the first ground coil 5 provided at the target train-stop position, and third ground coil information on the third ground coil 7 provided immediately ahead of the first ground coil 5 in the traveling direction of the train 11. When the train 11 is positioned between the position of the first ground coil 5 and the position of the third ground coil 7, the determination unit 106 determines, on the basis of the train position information, the first ground coil information, and the third ground coil information, that the train 11 has passed the target train-stop position, and thus determines the position of the third ground coil 7, as a train stop position. As a result, in a case where the train 11 does not stop at a predetermined position on the platform of a station, the vehicle doors can be opened in a shorter time than conventionally required.

In the platform-door control system 2 according to the second embodiment, the on-board control apparatus 20 includes the determination unit 106 that determines whether the train 11 has passed the target train-stop position, on the basis of the information on the ground coil and the train position information. The information on the ground coil includes the first ground coil information on the first ground coil 5 provided at the target train-stop position, and the third ground coil information on the third ground coil 7 provided immediately ahead of the first ground coil 5 in the traveling direction of the train 11. When the train 11 is positioned between the position of the first ground coil 5 and the position of the third ground coil 7, the determination unit 106 determines, on the basis of the train position information, the first ground coil information, and the third ground coil information, that the train 11 has passed the target train-stop position, and thus determines the position of the third ground coil 7, as a train stop position. As a result, in a case where the train 11 does not stop at a predetermined position on the platform of a station, the vehicle doors can be opened in a shorter time than conventionally required.

Third Embodiment

Figure 11:
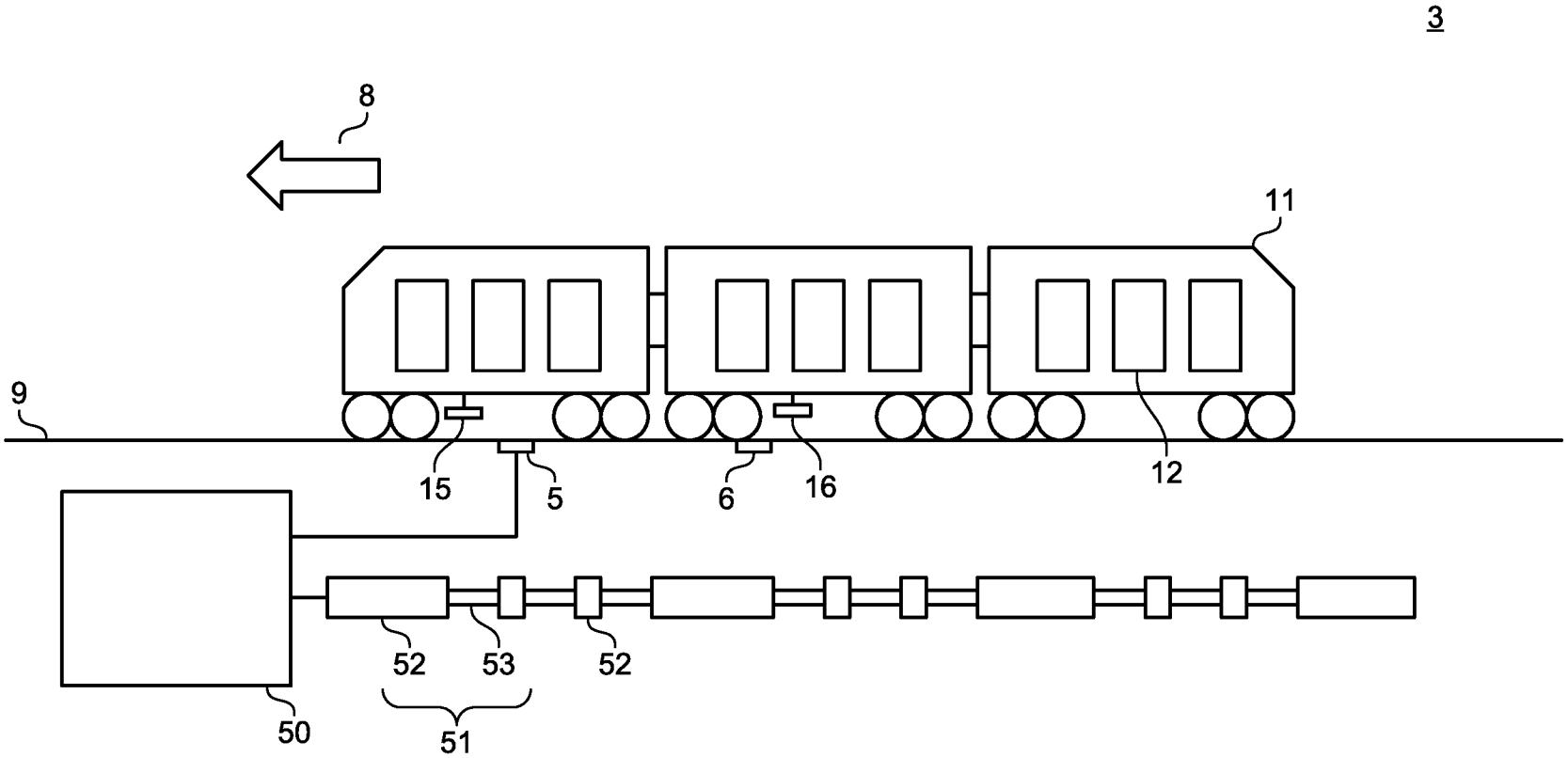
FIG. 11 is a diagram illustrating a configuration of a platform-door control system according to a third embodiment.

FIG. 11 is a diagram illustrating a configuration of a platform-door control system 3 according to a third embodiment. The platform-door control system 3 has a feature that the platform-door control system 3 includes a plurality of pickup coils of the train 11. In FIG. 11, a pickup coil is provided in each of the first car and the second car. These two pickup coils are referred to as "first pickup coil" and "second pickup coil", respectively. The distance between the first pickup coil and the second pickup coil is equivalent to the length of a single vehicle of the train 11. Configurations of respective devices of the third embodiment are identical to those of the first and second embodiments unless otherwise specified.

Figure 12:
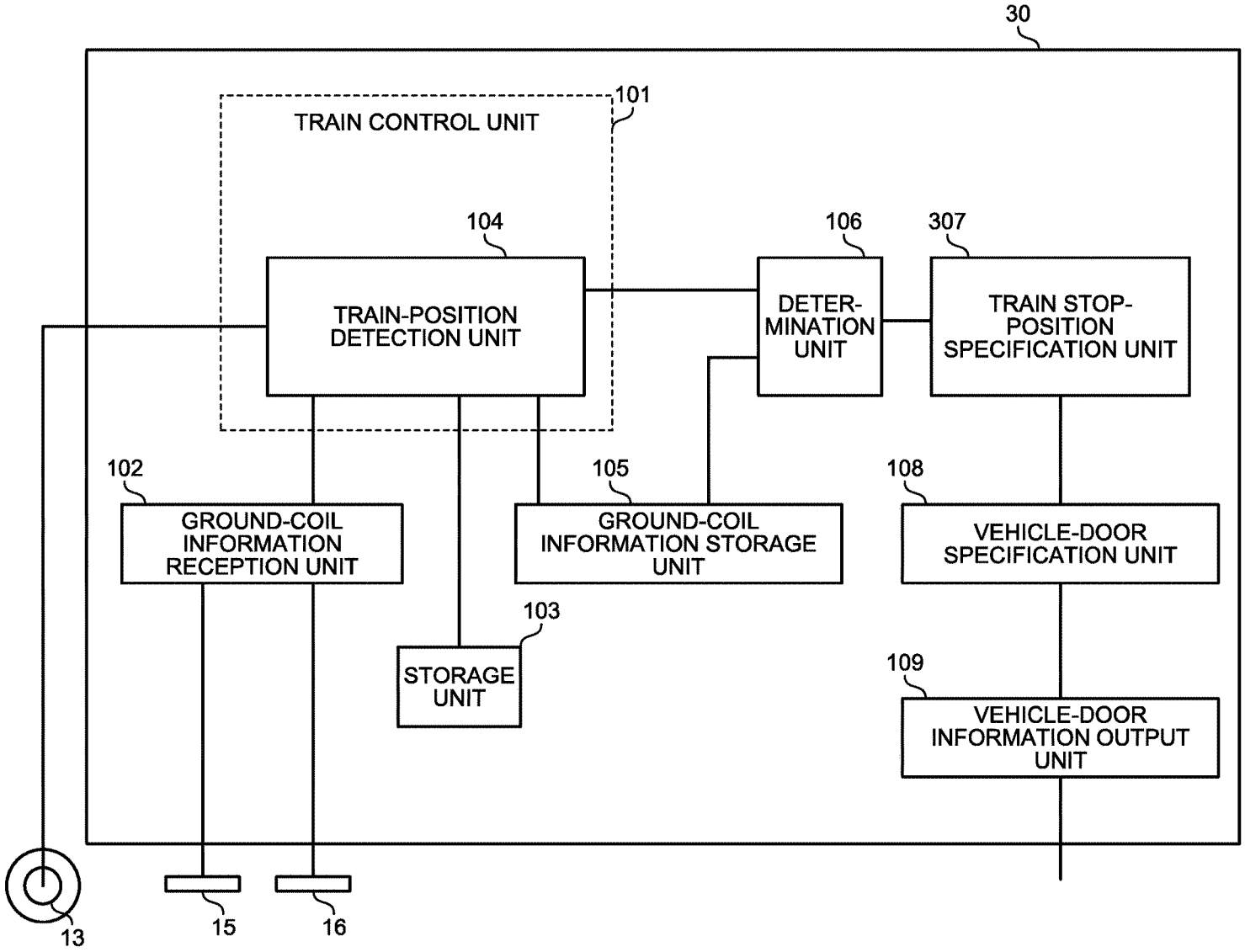
FIG. 12 is a diagram illustrating a configuration of an on-board control apparatus in the platform-door control system according to the third embodiment.

FIG. 12 is a diagram illustrating a configuration of an on-board control apparatus 30 of the train 11 in the platform-door control system 3 according to the third embodiment. The on-board control apparatus 30 has a feature that the ground-coil information reception unit 102 is connected to a first pickup coil 15 and a second pickup coil 16.

Operations of the platform-door control system 3 according to the third embodiment are described below. Descriptions in the operations of the third embodiment are the same as those of the first and second embodiments unless otherwise specified.

The train-position detection unit 104 calculates the position of the corresponding train on the basis of: the movement amount of the corresponding train output from the rate generator 13; and the ground-coil position information on the ground coil P0 stored in the ground-coil information storage unit 105. The train-position detection unit 104 then outputs the calculated position of the corresponding train, which is train position information, to a train stop-position specification unit 307.

The determination unit 106 detects, from train speed information output from the train control unit 101, whether the corresponding train has stopped. For example, when the train speed information indicates a speed higher than 0.5 km/h, the determination unit 106 determines that the corresponding train has not stopped. When the determination unit 106 detects that the corresponding train has not stopped, the determination unit 106 determines, on the basis of most recently received ground coil information, whether the corresponding train has passed the target train-stop position. The determination unit 106 detects that the corresponding train has not stopped, in which case the determination unit 106 determines that the corresponding train has passed the target train-stop position as the most recently received ground coil information is a signal from the ground coil P0.

When the determination unit 106 detects that the corresponding train has not stopped and thus determines that the corresponding train has passed the target train-stop position, then the train stop-position specification unit 307 determines the stop position of the corresponding train as a position where the second pickup coil 16 overlaps the ground coil P0, on the basis of: the train position information calculated by the train-position detection unit 104; and the ground-coil position information of the ground coil P0 stored in the ground-coil information storage unit 105.

When the train stop-position specification unit 307 determines the stop position of the corresponding train as a position where the second pickup coil 16 overlaps the ground coil P0, the train control unit 101 newly generates a speed check pattern such that the corresponding train can stop at the position where the second pickup coil 16 overlaps the ground coil P0. Then, the train control unit 101 decelerates the corresponding train in accordance with the newly generated speed check pattern to stop the corresponding train with the second pickup coil 16 at the position of the ground coil P0.

The train stop position determined by the train stop-position specification unit 307 is output to the vehicle-door specification unit 108.

On the basis of the determined train stop position, the vehicle-door specification unit 108 determines which vehicle-door opening/closing unit 12 needs to be opened/closed among the vehicle-door opening/closing units 12 of the corresponding train. Because the distance between the first pickup coil 15 and the second pickup coil 16 is equivalent to the length of a single vehicle of the train 11, the vehicle-door specification unit 108 determines that the vehicle-door opening/closing units 12 of the first car are not to be opened/closed, but the vehicle-door opening/closing units 12 of the second and third cars are to be opened/closed, and outputs vehicle door information to that effect to the vehicle-door information output unit 109.

The vehicle-door information output unit 109 outputs the determined vehicle door information through the pickup coil and the ground coil P0 to the platform-door control apparatus 50.

The platform-door control apparatus 50 receives the vehicle door information output from the train 11, and determines, on the basis of the vehicle door information, the platform-door opening/closing unit 53 to be opened/closed. For example, the platform-door control apparatus 50 determines that all of the platform doors other than the platform-door opening/closing units 53 of the third group are to be opened/closed. After the platform doors of the determined platform-door opening/closing units 53 are opened, the determined vehicle-door opening/closing units 12 are opened, thereby allowing passengers to board and deboard the train 11.

In the third embodiment, the distance between the first pickup coil 15 and the second pickup coil 16 is equivalent to the length of a single vehicle of the train 11. However, the distance is not limited thereto. It is only required that the distance between the first pickup coil 15 and the second pickup coil 16 be stored in advance in the storage unit 103. It is only required that the train stop-position specification unit 307 determine the train stop position corresponding to the distance stored in advance in the storage unit 103.

The on-board control apparatus 30 according to the third embodiment includes the determination unit 106 that determines whether the train 11 has passed the target train-stop position, on the basis of the information on the ground coil and the train position information. The train 11 includes a plurality of pickup coils including the first pickup coil 15 and the second pickup coil 16 arranged in that order in the traveling direction of the train 11 (the direction of an arrow 8 in FIG. 11). When the determination unit 106 determines that the train 11 has passed the target train-stop position, on the basis of: the information on the ground coil P0 received by the first pickup coil 15; and the train position information, the train stop-position specification unit 307 determines the train stop position such that the second pickup coil 16 is at the position of the ground coil P0. As a result, in a case where the train 11 does not stop at a predetermined position on the platform of a station, the vehicle doors can be opened in a shorter time than conventionally required.

In the platform-door control system 3 according to the third embodiment, the on-board control apparatus 30 includes the determination unit 106 that determines whether the train 11 has passed the target train-stop position, on the basis of the information on the ground coil and the train position information. The train 11 includes a plurality of pickup coils including the first pickup coil 15 and the second pickup coil 16 arranged in that order in the traveling direction of the train 11. When the determination unit 106 determines that the train 11 has passed the target train-stop position, on the basis of: the information on the ground coil P0 received by the first pickup coil 15; and the train position information, the train stop-position specification unit 307 determines the train stop position such that the second pickup coil 16 is at the position of the ground coil P0. As a result, in a case where the train 11 does not stop at a predetermined position on the platform of a station, the vehicle doors can be opened in a shorter time than conventionally required.

Fourth Embodiment

Figure 13:
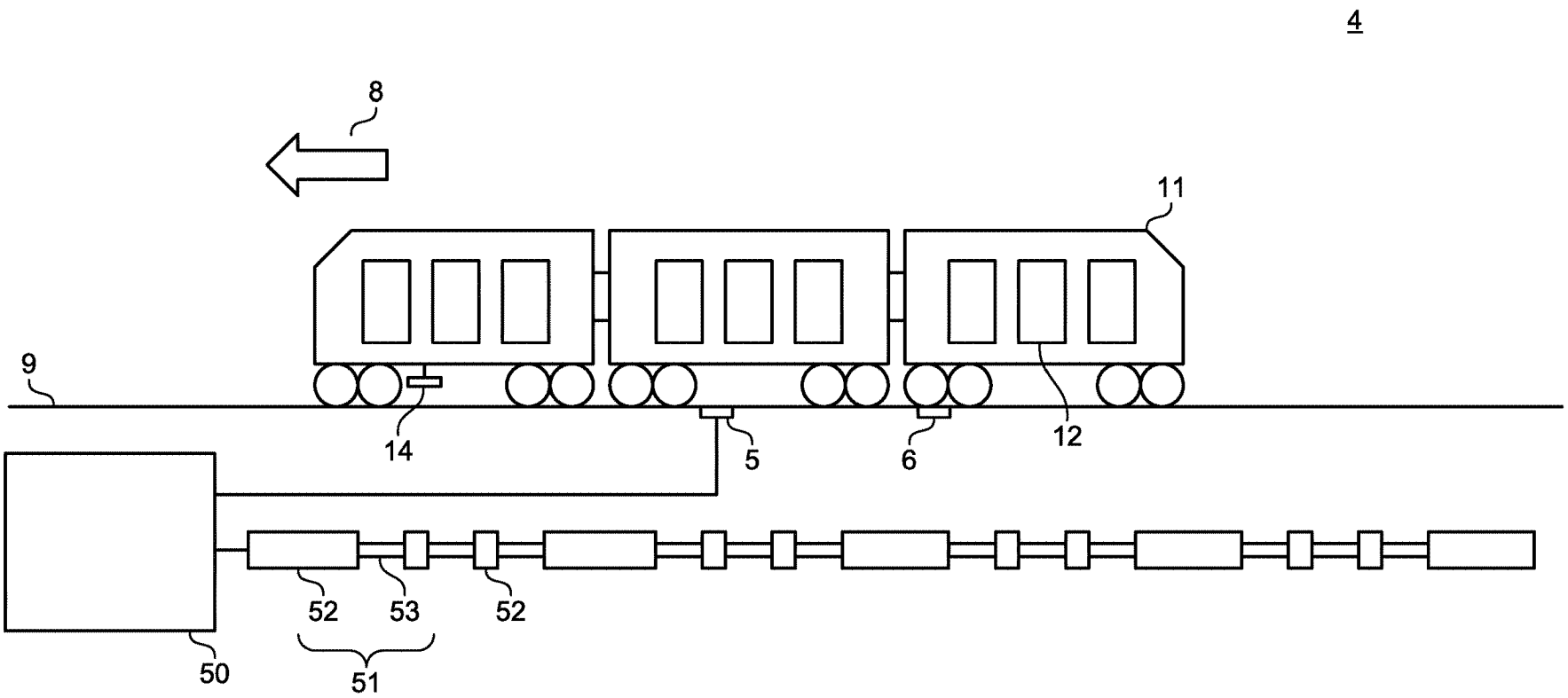
FIG. 13 is a diagram illustrating a configuration of a platform-door control system according to a fourth embodiment.

FIG. 13 is a diagram illustrating a configuration of a platform-door control system 4 according to a fourth embodiment. The platform-door control system 4 has a feature that the platform-door control system 4 includes a larger number of platform-door opening/closing units 53 of the platform-door device 51 as compared to the first to third embodiments. The platform-door opening/closing units 53 of the platform-door device 51 installed at a station are installed in consideration of the number of vehicles of the train 11 that stops at the station. For a station at which the train 11 made up of four vehicles stops, the platform-door opening/closing units 53 are installed in correspondence in number to the four vehicles of the train 11. In FIG. 13, the number of the platform-door opening/closing units 53 of the platform-door device 51 installed at a station corresponds to the four vehicles of the train 11. The platform-door opening/closing unit 53 of the platform-door device 51 is also installed ahead of the target train-stop position in the traveling direction of the train 11 (the direction of an arrow 8 in FIG. 13). Configurations of respective devices of the fourth embodiment are identical to those of the first to third embodiments unless otherwise specified. In this example, three leading platform-door opening/closing units 53 in the traveling direction of the train 11 are grouped into a single group, and there are twelve platform-door opening/closing units 53 from the front in the traveling direction of the train 11. That is, because each group is made up of three platform-door opening/closing units 53, there are four groups in total. In each of the groups, the three platform-door opening/closing units 53 are referred to as "first platform-door opening/closing unit", "second platform-door opening/closing unit", and "third platform-door opening/closing unit", respectively, in order from the front.

Figure 14:
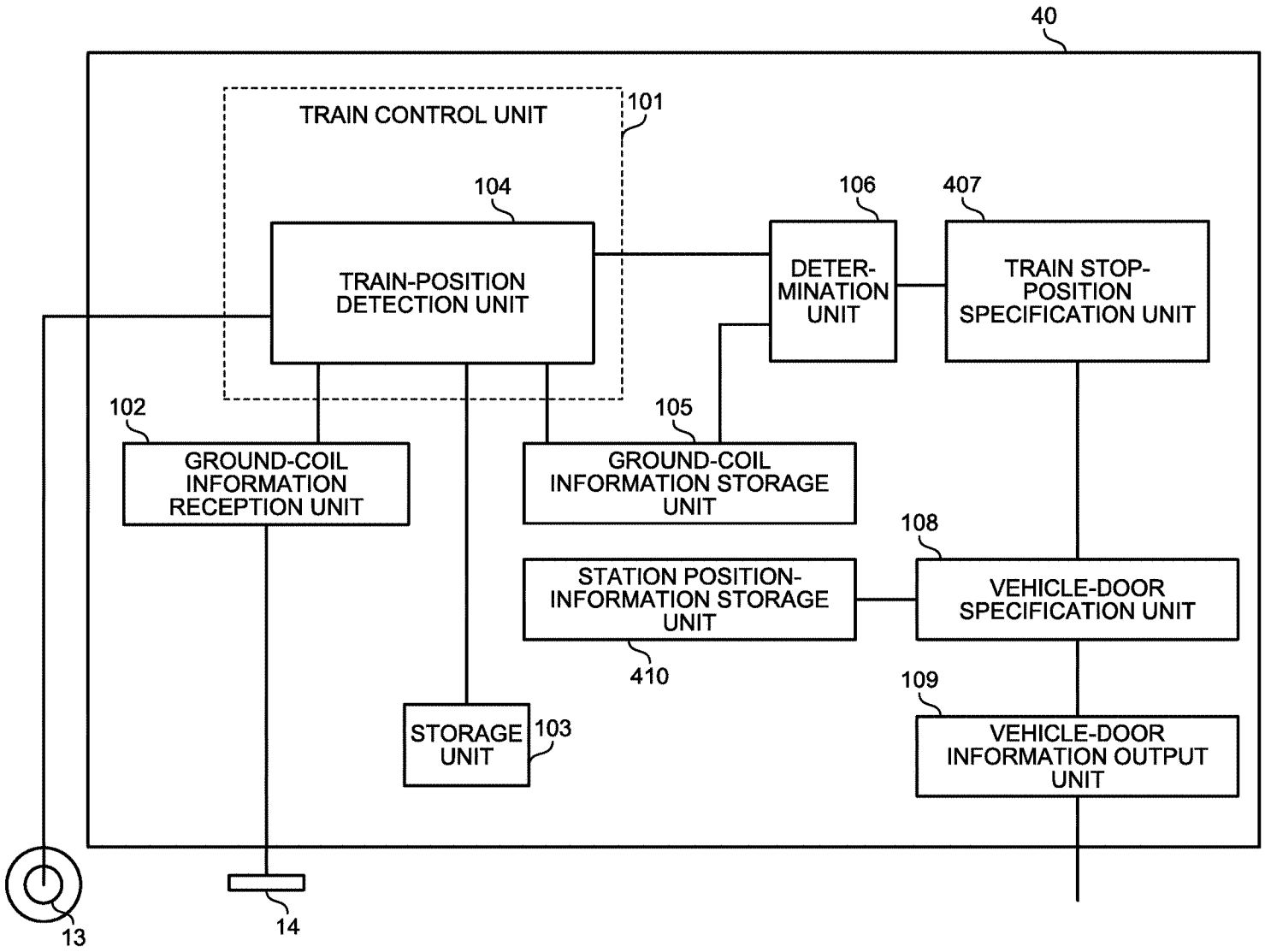
FIG. 14 is a diagram illustrating a configuration of an on-board control apparatus in the platform-door control system according to the fourth embodiment.

FIG. 14 is a diagram illustrating a configuration of an on-board control apparatus 40 of the train 11 in the platform-door control system 4 according to the fourth embodiment. The on-board control apparatus 40 has a feature that the on-board control apparatus 40 includes a station position-information storage unit 410.

The station position-information storage unit 410 stores therein position information on stations (station position information) located along the service route on which the train 11 runs. Examples of the stored station position information include distance information in kilometers at one end and at the other end of the platform of the station. Because the distance information in kilometers at one end of the platform of the station and the distance information in kilometers at the other end are stored, it is possible to calculate the length of the platform of the station. Examples of the stored station position information may also include distance information in kilometers at one end and at the other end of the platform-door device 51 installed at the station. Because the distance information in kilometers at one end and at the other end of the platform-door device 51 is stored, it is possible to calculate the entire length of the platform-door device 51 installed on the platform. The station position-information storage unit 410 may be configured separately from the storage unit 103 described above, or the storage unit 103 may include the station position-information storage unit 410.

Next, operations of the platform-door control system 4 according to the fourth embodiment are described. Descriptions in the operations of the fourth embodiment are the same as those of the first to third embodiments unless otherwise specified. In the following descriptions, a case where the train 11 has stopped past the target train-stop position is explained as an example.

The train-position detection unit 104 calculates the position of the corresponding train on the basis of: the movement amount of the corresponding train output from the rate generator 13; and the ground-coil position information on the ground coil P0 stored in the ground-coil information storage unit 105. The train-position detection unit 104 then outputs the calculated position of the corresponding train, which is train position information, to a train stop-position specification unit 407.

The determination unit 106 detects that the corresponding train has stopped in which case the determination unit 106 determines that the corresponding train has stopped past the target train-stop position as the most recently received ground coil information is a signal from the ground coil P0.

The train stop-position specification unit 407 determines how far past the ground coil P0 the corresponding train has stopped, on the basis of: the train position information calculated by the train-position detection unit 104; and the ground-coil position information on the ground coil P0 stored in the ground-coil information storage unit 105. The determined train stop position is output to the vehicle-door specification unit 108.

On the basis of the determined train stop position and the station position information stored in the storage unit 103, the vehicle-door specification unit 108 determines which vehicle-door opening/closing unit 12 needs to be opened/closed among the vehicle-door opening/closing units 12 of the corresponding train. For example, in FIG. 13, the train 11 has stopped past the target train-stop position. Since the platform-door device 51 is also installed ahead of the target train-stop position in the traveling direction of the train 11, it is possible to open/close the vehicle-door opening/closing units 12 of the first to third cars. In such a case, the vehicle-door specification unit 108 refers to the station position information, and determines, on the basis of the length of the platform of the station or the entire length of the platform-door device 51, which vehicle-door opening/closing unit 12 needs to be opened/closed among the vehicle-door opening/closing units 12 of the corresponding train. The vehicle-door specification unit 108 outputs vehicle door information to that effect to the vehicle-door information output unit 109.

The vehicle-door information output unit 109 outputs the determined vehicle door information through the pickup coil 14 and the ground coil P0 to the platform-door control apparatus 50.

The platform-door control apparatus 50 receives the vehicle door information output from the train 11, and determines, on the basis of the vehicle door information, the platform-door opening/closing unit 53 to be opened/closed. After the determined platform-door opening/closing units 53 are opened, the determined vehicle-door opening/closing units 12 are opened, thereby allowing passengers to board and deboard the train 11.

The on-board control apparatus 40 according to the fourth embodiment includes the station position-information storage unit 410 that stores therein station position information that indicates position information on a station, and the vehicle-door specification unit 108 determines the vehicle doors of the train 11 to be opened/closed, on the basis of: the station position information stored in the station position-information storage unit 410; and the train stop position. As a result, in a case where the train 11 does not stop at a predetermined position on the platform of a station, the vehicle doors can be opened in a shorter time than conventionally required.

In the platform-door control system 4 according to the fourth embodiment, the on-board control apparatus 40 includes the station position-information storage unit 410 that stores therein station position information that indicates position information on a station, and the vehicle-door specification unit 108 determines the vehicle doors of the train 11 to be opened/closed, on the basis of: the station position information stored in the station position-information storage unit 410; and the train stop position. As a result, in a case where the train 11 does not stop at a predetermined position on the platform of a station, the vehicle doors can be opened in a shorter time than conventionally required.

Figure 15:
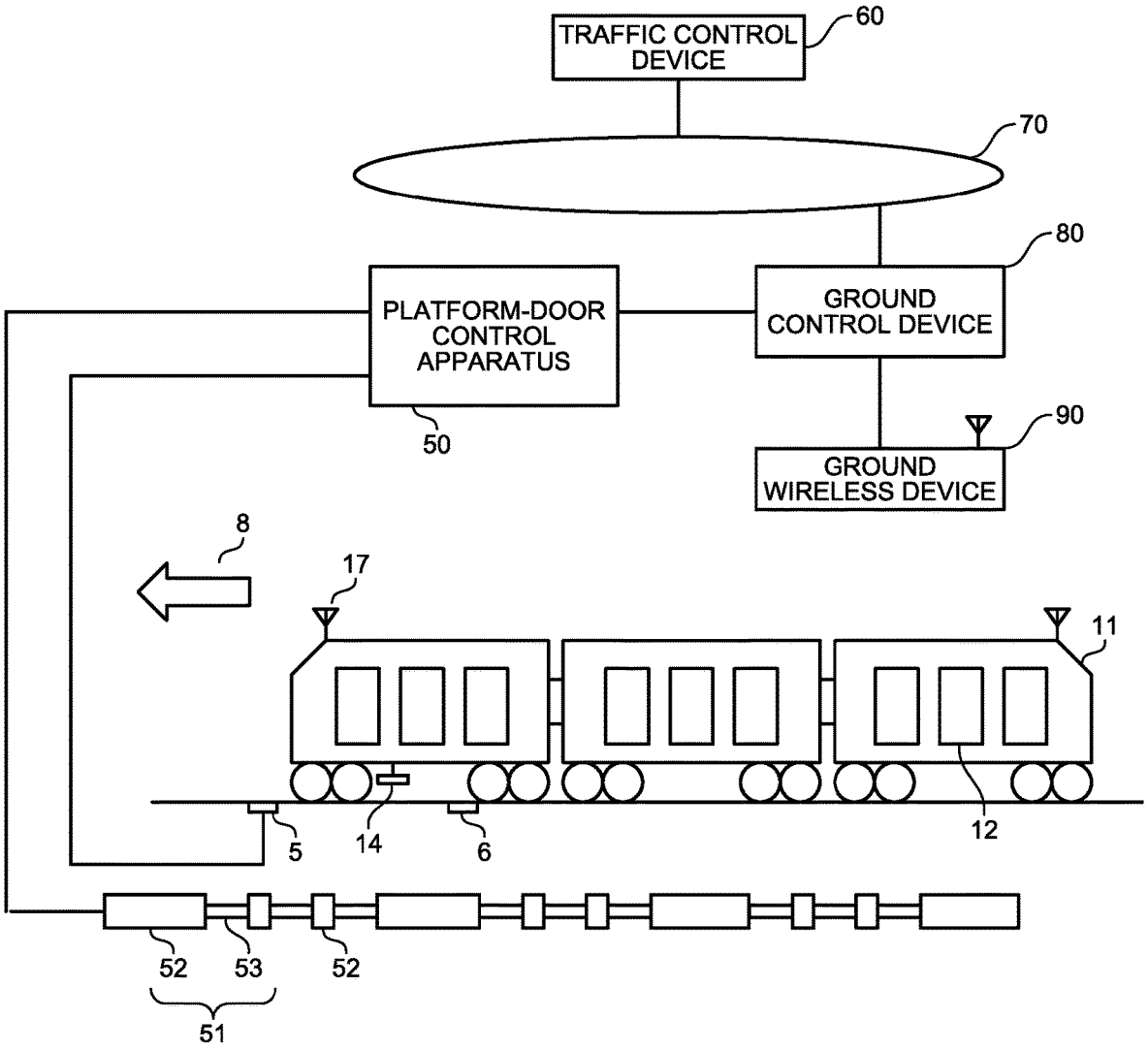
FIG. 15 is a diagram illustrating another configuration of the platform-door control system according to the first embodiment.

It is preferable to apply the platform-door control system according to the first to fourth embodiments to a wireless train control system. The first embodiment is described here as an example. FIG. 15 is a diagram illustrating the platform-door control system 1 according to the first embodiment as being applied to a wireless train control system. Configurations of respective devices are identical to those described above unless otherwise specified.

The platform-door control system 1 illustrated in FIG. 15 includes a traffic control device 60, a ground transmission path 70, a ground control device 80, the platform-door device 51, the platform-door control apparatus 50, a ground wireless device 90, an on-board wireless device, and the on-board control apparatus 10. The ground transmission path 70 is connected to the traffic control device 60. The ground control device 80 is installed on the ground and connected to the ground transmission path 70. The platform-door device 51 is installed at a station. The platform-door control apparatus 50 is connected to the ground control device 80. The ground wireless device 90 is installed on the ground and transmits and receives data to and from the ground control device 80 and the train 11. The on-board wireless device is installed in the train 11. The on-board wireless device is not illustrated in FIG. 15, but is described later. The on-board control apparatus 10 is installed in the train 11.

The traffic control device 60 is installed on the ground. The traffic control device 60 receives information from a plurality of ground control devices 80, manages the positions of the trains 11 running on all the railway lines, and transmits a departure command to each of the trains 11 via the ground wireless device 90.

The ground transmission path 70 allows for exchange of information between the ground control devices 80, and uses the information to control the interval between the train 11 and another train 11 running outside the management area.

The ground control device 80 receives data transmitted from the train 11 through the ground wireless device 90. For example, the ground control device 80 receives train position information from the train 11, and recognizes, from the received train position information, the position of the train 11. The received train position information is transmitted to the traffic control device 60 through the ground transmission path 70, so that the traffic control device 60 is capable of managing the position where the train 11 is running on the railway line.

The ground control device 80 receives vehicle door information from the train 11 through the ground wireless device 90, and transmits the received vehicle door information to the platform-door control apparatus 50. Accordingly, platform door information corresponding to the vehicle door information is output to the platform-door device 51, so that the specified platform-door opening/closing unit 53 is controllably opened/closed.

The ground wireless device 90 communicates with the on-board wireless device included in the train 11.

Figure 16:
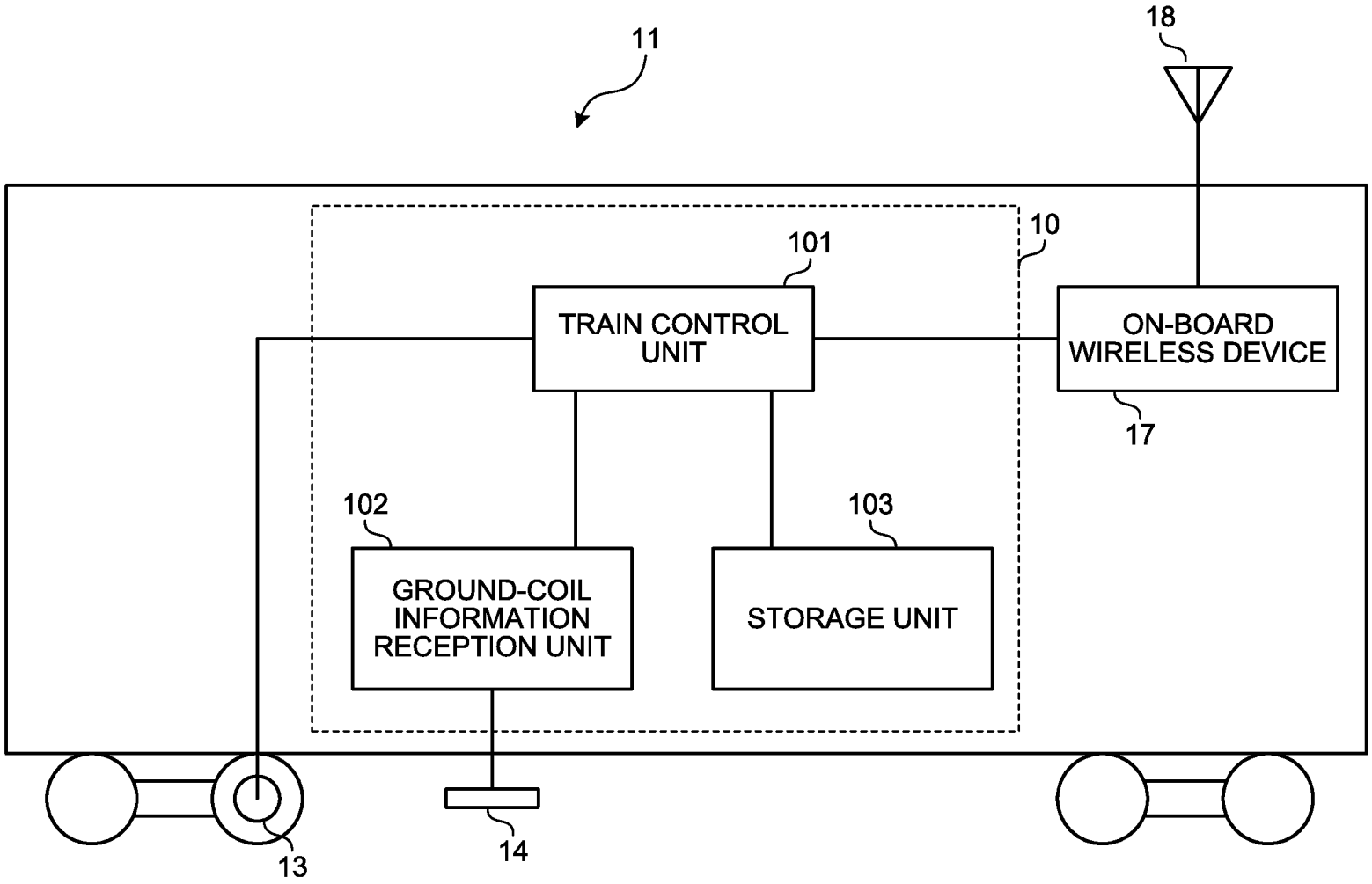
FIG. 16 is a diagram illustrating another configuration of the vehicle in the platform-door control system according to the first embodiment.

FIG. 16 is a diagram illustrating the on-board control apparatus 10 of the train 11 in a case where the platform-door control system 1 according to the first embodiment as being applied to the wireless train control system. Configurations of respective devices are identical to those described above unless otherwise specified.

The train 11 illustrated in FIG. 16 is provided with an on-board antenna 18, an on-board wireless device 17, and the on-board control apparatus 10. The on-board antenna 18 transmits and receives data to and from the ground wireless device 90. The on-board wireless device 17 is connected to the on-board antenna 18. The on-board control apparatus 10 is connected to the on-board wireless device 17, the rate generator 13, and the pickup coil 14. Vehicle door information is output from the on-board control apparatus 10 to the on-board wireless device 17. The vehicle door information output from the on-board control apparatus 10 is output from the on-board wireless device 17 through the on-board antenna 18 to the ground wireless device 90.

When the platform-door control system according to the first to fourth embodiments is applied to a wireless train control system, it is possible to wirelessly transmit determined vehicle door information to the platform-door control apparatus 50 even in a case where the train 11 has stopped at a position where the pickup coil 14 does not overlap the ground coil P0. It is also possible for the platform-door control apparatus 50 to output platform door information corresponding to the vehicle door information, to the platform-door device 51. After the determined platform-door opening/closing units 53 are opened, the determined vehicle-door opening/closing units 12 are opened, thereby allowing passengers to board and deboard the train 11. As a result, in a case where the train 11 does not stop at a predetermined position on the platform of a station, the vehicle doors can be opened in a shorter time than conventionally required.

In the first to fourth embodiments, it is preferable to use a speed sensor instead of the rate generator 13, or use the speed sensor in combination with the rate generator 13.

Figure 17:
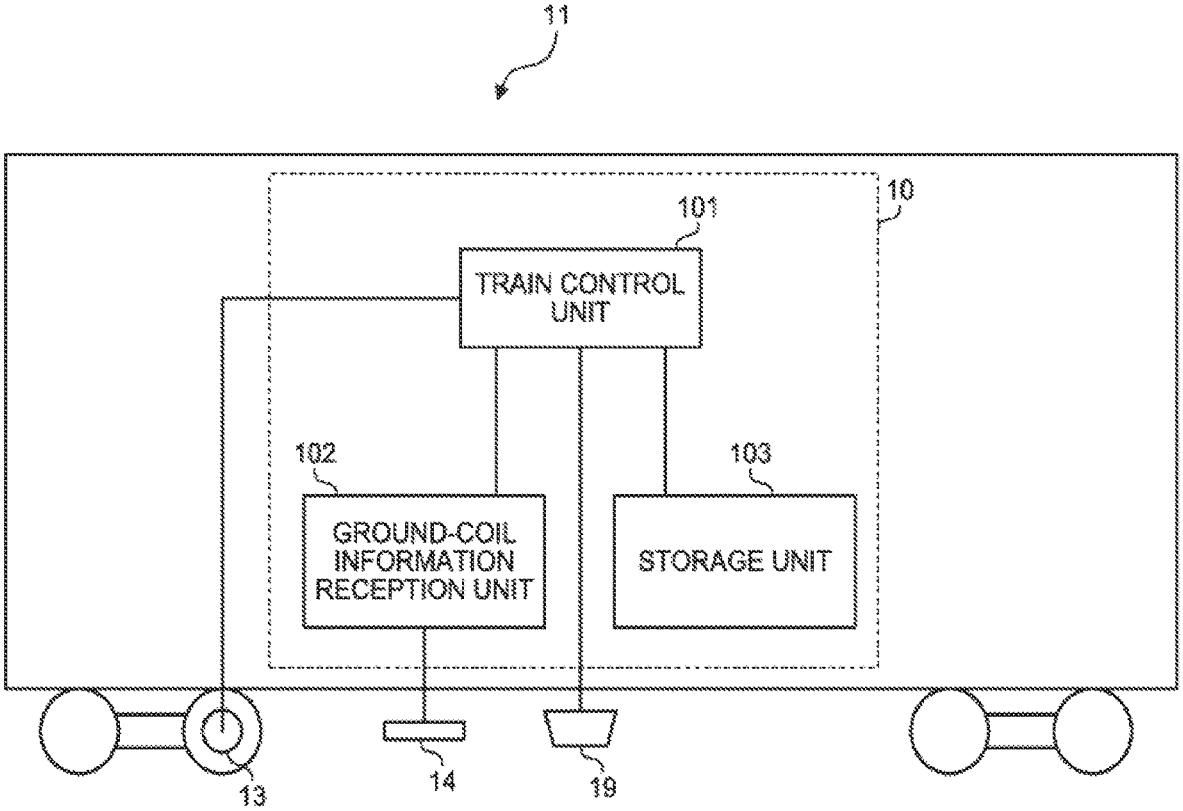
FIG. 17 is a diagram illustrating another configuration of the vehicle in the platform-door control system according to the first embodiment.

FIG. 17 is a diagram illustrating a configuration of the platform-door control system 1 according to the first embodiment in which the train 11 is provided with a speed sensor. Configurations of the respective devices are identical to those described above unless otherwise specified.

A speed sensor 19 is a device that detects the movement amount of the corresponding train and the speed of the corresponding train by using reflection of electromagnetic waves. The electromagnetic waves include radio waves and light. The speed sensor 19 includes an output unit that irradiates the rail surface with electromagnetic waves, and a detection unit that detects the electromagnetic waves reflected from the rail surface. The speed sensor 19 can detect the movement amount of the corresponding train in a non-contact manner. The speed sensor 19 is also capable of calculating the speed of the corresponding train, from the detected movement amount of the corresponding train. A Doppler sensor can be illustrated as an example of the speed sensor 19. The speed sensor 19 is not limited to any specific sensor provided that the sensor is capable of detecting the movement amount of the corresponding train and the speed of the corresponding train by using reflection of electromagnetic waves, instead of using rotation of the wheels.

The movement amount of the corresponding train and the speed of the corresponding train which are detected by the detection unit of the speed sensor 19 are input to the train control unit 101. The train control unit 101 calculates the position of the corresponding train on the basis of: the movement amount of the corresponding train detected by the speed sensor 19; and ground coil information. The calculated position of the corresponding train is treated as train position information. The speed of the corresponding train detected by the speed sensor 19 is treated as train speed information.

Because the speed sensor 19 is a sensor that does not use rotation of the wheels, the speed sensor 19 is less likely to be affected by wheel slip or skid. A sheet is laid on the rail surface on which the train 11 runs, thereby providing the reflective rail surface with more uniform quality and thus improving the detection accuracy. Particularly, a sheet is laid at a predetermined train stop position on the rail surface, thereby making it possible to obtain more accurate train position information and train speed information.

The accuracy in detecting the train position and train speed is improved not only by using the train position information and train speed information obtained on the basis of the detection results provided by the speed sensor 19, but also by combining the use of the train position information and train speed information obtained on the basis of the detection results provided by the rate generator 13. At a location where the accuracy of the sensor using reflection of electromagnetic waves can be ensured, the train control unit 101 can use detection results provided by the speed sensor 19 using reflection of electromagnetic waves, which sensor is less likely to be affected by wheel slip or skid. At a location where it is difficult to ensure the accuracy of the speed sensor 19 using reflection of electromagnetic waves, the train control unit 101 can use detection results provided by the rate generator 13.

In the first to fourth embodiments, use of the speed sensor 19 makes it possible to obtain more accurate train position information and train speed information. This improves the accuracy in detecting the train position by the train-position detection unit 104 and in detecting the stop of the train 11 by the determination unit 106. As a result, in a case where the train 11 does not stop at a predetermined position on the platform of a station, the vehicle doors can be opened in a shorter time than conventionally required.

Figure 18:
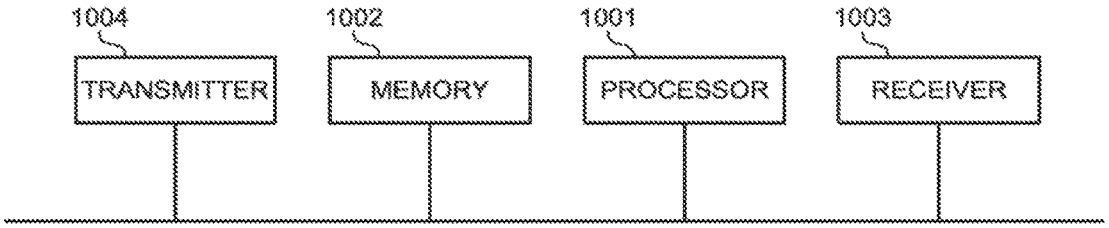
FIG. 18 is a diagram illustrating a general configuration example of hardware that implements the platform-door control system according to the first to fourth embodiments.

In the first to fourth embodiments described above, the configuration of the on-board control apparatus and the platform-door control apparatus 50 includes at least a processor, a memory, a receiver, and a transmitter. Operations of the respective devices can be implemented by software. FIG. 18 is a diagram illustrating a general configuration example of the hardware that implements the on-board control apparatus and the platform-door control apparatus 50 in the platform-door control system according to the first to fourth embodiments. The devices illustrated in FIG. 18 include a processor 1001, a memory 1002, a receiver 1003, and a transmitter 1004. The processor 1001 uses received data to perform software-based computation and execute software-based control. The memory 1002 stores therein the received data or data necessary for the processor 1001 to perform computation and execute control, and also stores therein software. The receiver 1003 is an interface that receives a signal or information input to the on-board control apparatus and the platform-door control apparatus 50. The transmitter 1004 is an interface that transmits a signal or information output from the on-board control apparatus and the platform-door control apparatus 50. The processor 1001, the memory 1002, the receiver 1003, and the transmitter 1004 may be respectively provided in plural.

In the present invention, the respective embodiments can be arbitrarily combined with each other, or the embodiments are modified or omitted as appropriate within the scope of the invention.

REFERENCE SIGNS LIST

1, 2, 3, 4 platform-door control system
5 ground coil P0
6 ground coil P1
7 ground coil PB
8 arrow
9 track
10, 20, 30, 40 on-board control apparatus
11 train
12 vehicle-door opening/closing unit
13 rate generator
14 pickup coil
15 first pickup coil
16 second pickup coil
17 on-board wireless device
18 on-board antenna
19 speed sensor
50 platform-door control apparatus
51 platform-door device
52 platform-door pocket
53 platform-door opening/closing unit
60 traffic control device
70 ground transmission path
80 ground control device
90 ground wireless device
101 train control unit
102 ground-coil information reception unit
103 storage unit
104 train-position detection unit
105 ground-coil information storage unit
106 determination unit
107, 207, 307, 407 train stop-position specification unit
108 vehicle-door specification unit
109 vehicle-door information output unit
410 station position-information storage unit
501 input/output unit
502 platform-door specification unit

503 platform-door information output unit
504 platform-door storage unit
1001 processor
1002 memory
1003 receiver
1004 transmitter

The invention claimed is:

1. An on-board control apparatus provided in a train, the apparatus comprising:

a ground-coil information storage to store therein information on one or more ground coils located on a track on which the train runs, the information on the one or more ground coils includes first ground coil information on a first ground coil;

a train-position detector to detect train position information comprising a position of the train;

a train stop-position specifier to determine a distance between the position of the train and the first ground coil provided at a target trainstop position on a basis of: (i) the first ground coil information on the first ground coil; and (ii) the train position information detected by the train-position detector;

a vehicle-door specifier to determine a vehicle door of the train to be opened/closed, on a basis of the determined distance; and a vehicle-door information transmitter to output determined vehicle door information of the train.

2. The on-board control apparatus according to claim 1, comprising:

a determiner to determine whether the train has passed a target train-stop position on a basis of the information on the one or more ground coils and the train position information; and a train-stop detector to detect that the train has stopped, wherein the information on the one or more ground coils includes second ground coil information on a second ground coil provided immediately before the first ground coil in a train traveling direction, and when the train-stop detector detects that the train has stopped, the determiner determines, on a basis of the train position information, the first ground coil information, and the second ground coil information, that the train has not passed the target train-stop position as the train is positioned between a position of the first ground coil and a position of the second ground coil, the determiner determining a position where the train has stopped, as a train stop position.

3. The on-board control apparatus according to claim 1, comprising a determiner to determine whether the train has passed a target train-stop position, on a basis of the information on the one or more ground coils and the train position information, wherein the information on the one or more ground coils includes third ground coil information on a third ground coil provided immediately ahead of the first ground coil in a train traveling direction, and when the train is positioned between a position of the first ground coil and a position of the third ground coil, the determiner determines, on a basis of the train position information, the first ground coil information, and the third ground coil information, that the train has passed the target train-stop position, the determiner determining a position of the third ground coil, as a train stop position.

4. The on-board control apparatus according to claim 1, comprising a determiner to determine whether the train has passed a target train-stop position, on a basis of the information on the one or more ground coils and the train position information, wherein the train includes a plurality of pickup coils including a first pickup coil and a second pickup coil arranged in that order in a train traveling direction, and when the determiner determines that the train has passed the target train-stop position, on a basis of: information on ground coil received by the first pickup coil; and the train position information, the train stop-position specifier determines the train stop position such that a position of the second pickup coil is at a position of the ground coil.

5. The on-board control apparatus according to claim 1, comprising a station position-information storage to store therein station position information that indicates position information on a station, wherein the vehicle-door specifier determines a vehicle door of the train to be opened/closed, on a basis of: the station position information stored in the station position-information storage; and the train stop position.

6. The on-board control apparatus according to claim 1, comprising a storage storing therein vehicle door opening/closing patterns of the train, wherein the vehicle-door specifier includes a vehicle-door opening/closing pattern selector to select, from among vehicle door opening/closing patterns stored in the storage, a vehicle door opening/closing pattern based on the distance between the detected position of the train and the first ground coil, determined by the train stop-position specifier, and a vehicle-door opening/closing pattern transmitter to output the selected vehicle door opening/closing pattern.

7. A platform-door control system comprising:

an on-board control apparatus provided in a train and including:

a ground-coil information storage to store therein information on one or more ground coils located on a track on which the train runs, the information on the one or more ground coils including first ground coil information on a first ground coil;

a train-position detector to detect train position information comprising a position of the train;

a train stop-position specifier to determine a distance between the position of the train and the first ground coil provided at a target train-stop position on a basis of: (i) the first ground coil information on the first ground coil; and (ii) train position information detected by the train-position detector;

a vehicle-door specifier to determine a vehicle door of the train to be opened/closed, on a basis of the determined distance; and a vehicle-door information transmitter to output determined vehicle door information of the train; and a platform-door control apparatus to receive the vehicle door information output from the vehicle-door information transmitter, and control platform doors installed at a station.

8. The platform-door control system according to claim 7, wherein the on-board control apparatus includes:

a determiner to determine whether the train has passed a target train-stop position, on a basis of the information on the one or more ground coils and the train position information, and a train-stop detector to detect that the train has stopped, the information on the one or more ground coils includes second ground coil information on a second ground coil provided immediately before the first ground coil in a train traveling direction, and when the train-stop detector detects that the train has stopped, the determiner determines, on a basis of the train position information, the first ground coil information, and the second ground coil information, that the train has not passed the target train-stop position as the train is positioned between a position of the first ground coil and a position of the second ground coil, the determiner determining a position where the train has stopped, as a train stop position.

9. The platform-door control system according to claim 7, wherein the on-board control apparatus includes a determiner to determine whether the train has passed a target train-stop position, on a basis of the information on the one or more ground coils and the train position information, the information on the one or more ground coils includes third ground coil information on a third ground coil provided immediately ahead of the first ground coil in a train traveling direction, and when the train is positioned between a position of the first ground coil and a position of the third ground coil, the determiner determines, on a basis of the train position information, the first ground coil information, and the third ground coil information, that the train has passed the target train-stop position, the determiner determining a position of the third ground coil, as a train stop position.

10. The platform-door control system according to claim 7, wherein the on-board control apparatus includes a determiner to determine whether the train has passed a target train-stop position, on a basis of the information on the one or more ground coils and the train position information, the train includes a plurality of pickup coils including a first pickup coil and a second pickup coil arranged in that order in a train traveling direction, and when the determiner determines that the train has passed the target train-stop position, on a basis of: information on ground coil received by the first pickup coil; and the train position information, the train stop-position specifier determines the train stop position such that a position of the second pickup coil is at a position of the ground coil.

11. The platform-door control system according to claim 7, wherein the on-board control apparatus includes a station position-information storage to store therein station position information that indicates position information on a station, and the vehicle-door specifier determines a vehicle door of the train to be opened/closed, on a basis of: the station position information stored in the station position-information storage; and the train stop position.

12. The platform-door control system according to claim 7, wherein the on-board control apparatus includes a storage storing therein vehicle door opening/closing patterns of the train, and the vehicle-door specifier includes a vehicle-door opening/closing pattern selector to select, from among vehicle door opening/closing patterns stored in the storage, a vehicle door opening/closing pattern based on the distance determined by the train stop-position specifier, and a vehicle-door opening/closing pattern transmitter to output the selected vehicle door opening/closing pattern.

13. The platform-door control system according to claim 7, wherein the platform-door control apparatus includes: a platform-door specifier to determine a door of the platform doors to be opened/closed; and a platform-door information transmitter to output information on a platform door determined by the platform-door specifier, the platform-door control apparatus controlling opening/closing of the platform doors on a basis of information on the determined platform door output from the platform-door information transmitter.

14. The platform-door control system according to claim 13, wherein the vehicle-door information transmitter outputs the vehicle door opening/closing pattern that is the vehicle door information, and the platform-door control apparatus includes a platform-door storage storing therein platform-door opening/closing patterns, and the platform-door specifier determines, from the platform-door storage, a platform-door opening/closing pattern corresponding to the vehicle door opening/closing pattern.

* * * * *